US006412774B1

(12) United States Patent
Saito et al.

(10) Patent No.: US 6,412,774 B1
(45) Date of Patent: Jul. 2, 2002

(54) SHEET RECEIVING APPARATUS

(75) Inventors: Takashi Saito, Koufu; Shigeyuki Sanmiya, Yamanashi-ken, both of (JP)

(73) Assignee: Nisca Corporation, Yamanashi-ken (JP)

( * ) Notice: Subject to any disclaimer, the term of this patent is extended or adjusted under 35 U.S.C. 154(b) by 13 days.

(21) Appl. No.: 09/590,270

(22) Filed: Jun. 9, 2000

(30) Foreign Application Priority Data

| | | |
|---|---|---|
| Jun. 11, 1999 | (JP) | 11-165949 |
| Apr. 21, 2000 | (JP) | 2000-120500 |
| Apr. 21, 2000 | (JP) | 2000-120502 |
| Jun. 7, 2000 | (JP) | 2000-171182 |

(51) Int. Cl.[7] ..... B65H 31/26
(52) U.S. Cl. ..... 271/220; 271/221
(58) Field of Search ..... 271/220, 207, 271/221, 241; 270/58.12, 58.27

(56) References Cited

U.S. PATENT DOCUMENTS

| | | | | |
|---|---|---|---|---|
| 3,847,388 A | * | 11/1974 | Lynch | 271/220 X |
| 4,084,809 A | * | 4/1978 | Looney | 271/220 |
| 4,883,265 A | * | 11/1989 | Iida et al. | 271/220 |
| 5,021,837 A | * | 6/1991 | Uto et al. | |
| 5,026,034 A | * | 6/1991 | Russel et al. | |
| 5,137,265 A | * | 8/1992 | Sato et al. | |
| 5,249,793 A | * | 10/1993 | Scheufler | 271/220 |
| 5,288,062 A | * | 2/1994 | Rizzolo et al. | 271/220 X |
| 5,385,340 A | * | 1/1995 | Hiroi et al. | |

* cited by examiner

*Primary Examiner*—David H. Bollinger
(74) *Attorney, Agent, or Firm*—Kanesaka & Takeuchi

(57) ABSTRACT

A sheet receiving apparatus includes a sheet placing surface inclined such that the sheet is placed toward an upstream side of an ejecting direction of a sheet ejecting device, a sheet pressing device for pressing the sheet toward the second sheet placing surface, a driving device connected to the sheet pressing device for retreating the sheet pressing device from the sheet placing surface every time the sheet is ejected and moving the sheet pressing device back to the sheet placing surface, and a sheet detecting device located at the upstream side of the ejecting device for detecting the sheet and actuating the driving device. The sheet can be properly stacked and placed on the sheet placing surface.

13 Claims, 23 Drawing Sheets

SHEET RECEIVING APPARATUS

BACKGROUND OF THE INVENTION

1. Field of Related Art

The present invention relates to a sheet receiving apparatus used for stacking or temporarily placing sheets, on which images are formed, ejected from an image forming apparatus, such as a copier and printer.

Particularly, the invention relates to a sheet receiving apparatus, in which sheets ejected sequentially are stacked or placed with good alignment, and a jam caused by collision between the stacked or placed sheet and a sheet ejected subsequently thereto is prevented, so that a stacking performance or placing performance is not deteriorated.

2. Prior Arts

Conventionally, an apparatus for accumulating and stacking sheets, on which images are formed in an image forming apparatus, such as a copier and printer, has been known. It is needless to say that the apparatus of this type can stack image-formed sheets in a relatively large amount, and also in the apparatus, right before stacking, the sheets ejected from the image forming apparatus are temporarily placed. A predetermined process, such as aligning sheets, stapling, and sorting by sheet shift, is made to the sheets in the temporarily placed condition, and then after the process, the sheets are stacked.

As described above, among apparatuses for stacking sheets, or for stacking sheets after sheets are temporarily placed and predetermined process is made to the sheets before stacking, the apparatuses which have comparatively achieved the miniaturization are disclosed in U.S. Pat. No. 5,021,837, U.S. Pat. No. 5,137,265, and U.S. Pat. No. 5,385,340.

In the disclosed apparatuses, however, sufficient considerations are not made for improving a stacking ability in case of stacking the sheets, or improving a sheet placement performance in case of temporarily placing the sheets before stacking.

Namely, the already stacked or placed sheet may abut against a forward end of a sheet subsequently sent to cause a jam, or a subsequently sent sheet may be stacked on the stacked or placed sheet in a curled condition so that sheets in the folded condition are stacked or placed. Thus, without reaching an amount of stacking or placing set in advance, it is determined that stacking or placing comes to the limit even though the amount is a few, so that the apparatus must be stopped.

To solve the above problem, a height difference between an ejection port for sheets and a support surface for receiving the sheets should be sufficiently large. However, in this case, when the forward end of the ejected sheet is ejected in a downward curl in a sheet support surface side, the sheet in a downward curl on the support surface is ejected as it is, so that the sheet is folded and then stacked or placed, resulting in causing the same problem as mentioned above.

OBJECT OF THE INVENTION

An object of the invention is to provide a sheet receiving apparatus, which prevents an unnecessary abutment between the stacked sheet and the subsequently ejected sheet, or placing or stacking the sheets in a curled condition in case of stacking the ejected sheets, to thereby improve the performance for stacking the sheets.

Another object of the invention is to provide a sheet receiving apparatus, wherein in order to conduct a predetermined process to the sheet before the sheet is ejected to an outside of the apparatus, even in case of temporarily placing the sheets, a jam caused by collision between the placed sheet and the subsequent sheet is prevented, and the performance of placing the sheet for enabling to securely place the predetermined number of sheets temporarily can be secured.

Still another object of the invention is to provide a sheet receiving apparatus, which can stack or place the sheets by precisely aligning the sheets, and at the same time, which is miniaturized and light-weighed as a whole.

SUMMARY OF THE INVENTION

To achieve the above objects, a sheet receiving apparatus of the invention is formed of ejecting means for ejecting a sheet to a piling stacker in order to stack the sheets; a sheet placing surface of the piling stacker, which places the sheet ejected along the sheet ejecting direction from the ejecting means and is inclined to be higher toward an upstream side of the ejecting direction, wherein the sheet placing surface is formed of a first sheet placing surface for placing the sheet with a first angle formed by the sheet ejecting direction and the sheet placing surface, and a second sheet placing surface, which places the sheet thereon and is set at an angle larger than the first angle at an upper stream side of the ejecting direction than a position where the first sheet placing surface intersects the sheet ejecting direction; and sheet pressing means which presses the sheet against the second sheet placing surface and is moved by driving means, such as a solenoid.

Also, the sheet pressing means is arranged to project and retract every time the sheet is ejected from a sheet end regulating member side for regulating movement of the sheet in the condition that the sheet is placed on the placing surface, and a timing of projecting and retracting is operated by sheet rear end detecting means located at an upstream side of the ejecting means.

In the sheet receiving apparatus of the invention, also, in order to apply the predetermined processes, such as aligning and binding, to the sheets, before the sheets are completely ejected to the piling stacker, the sheets are temporarily placed on a temporary placing tray located at the upstream side of the sheet ejecting direction. In order to improve an accuracy for aligning and a performance of placing the sheets on the temporary placing tray, sheet transferring means for transferring the sheets on the temporary placing tray is formed of a ring-shaped member flexibly deforming in a thickness direction of the sheets on the temporary placing tray and a crossing direction, respectively, or a transferring unit in which the ring-shaped member is extended between a driving pulley and a driven pulley and which can move in the sheet thickness direction. Also, there is provided aligning means for pressing the sheets, which are transferred onto the temporary placing tray by the transferring means, from the sheet width direction to thereby align the sheets. Then, a positional relationship between the sheet transferring means and the aligning means is structured such that the aligning means regulates a side rim of the sheet at a position where the sheet transferring means contacts the sheet. Incidentally, the arrangement relation, in which the sheet transferring means and the aligning means are overlapped as seen from a direction of the section, contributes to making the apparatus compact.

Further, in order to improve the sheet placing performance in the temporary placing tray, the sheet receiving apparatus of the invention is provided with the sheet pressing means which approaches the upper surface on the temporary placing tray in accordance with the direction of transferring the sheets transferred on the temporary placing tray by the sheet transferring means, and the sheet pressing means is structured to increase the pressing force against the placed sheets in accordance with an increase of the sheets placed on the temporary placing tray.

Further objects and features of the invention will be apparent from the following detail description of the invention with reference to the attached drawings.

PREFERRED EMBODIMENTS

The present invention relates to a sheet receiving apparatus, in which stacking performance in case of stacking ejected sheets, and placement performance in case of temporality placing the sheets before ejecting the sheets are improved, and an embodiment of the invention is explained with reference to the attached drawings.

Figure 1:
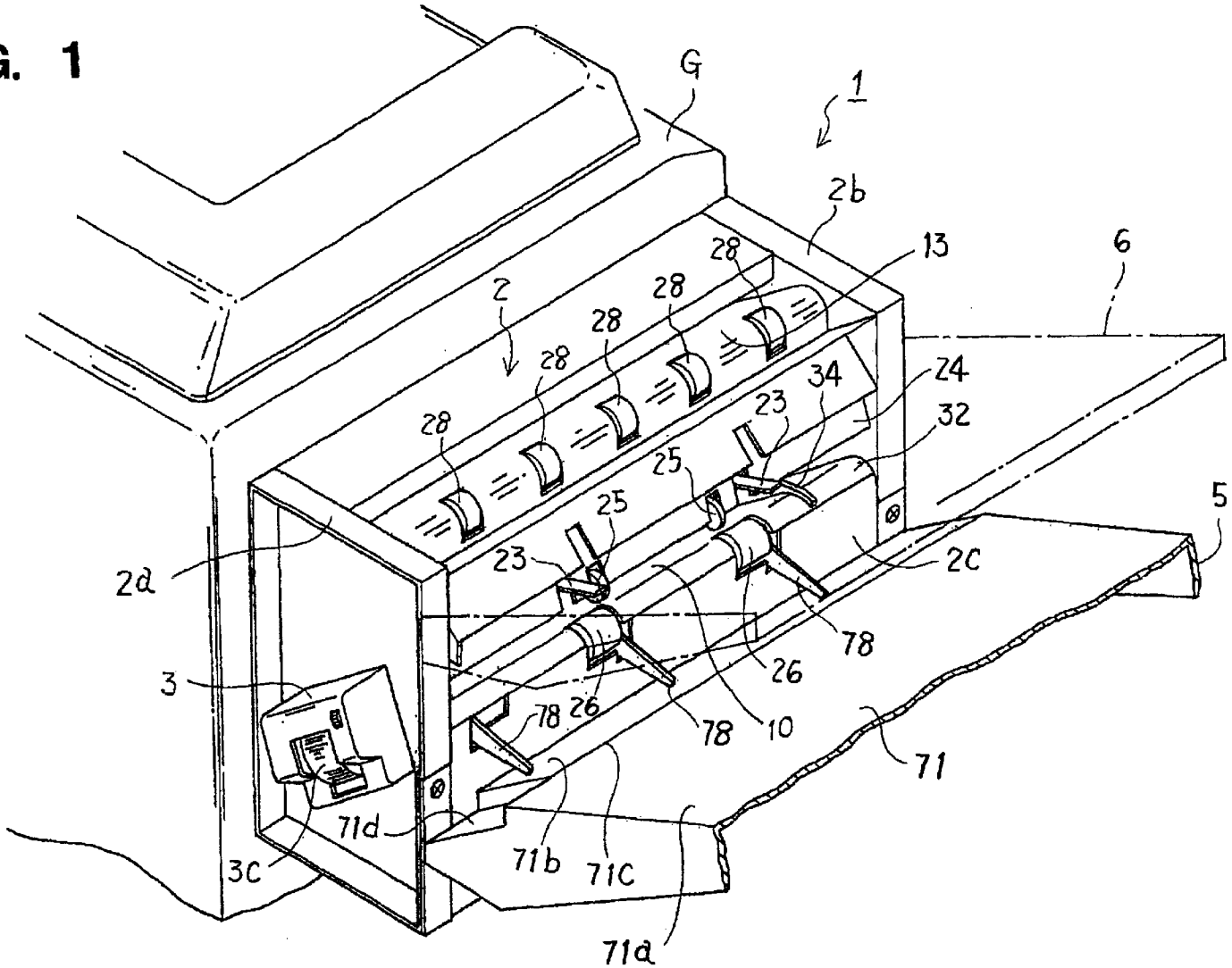
FIG. 1 is a schematic perspective view of a sheet receiving apparatus of a first type as an embodiment of the invention, wherein a part of the apparatus is omitted.
Figure 2:
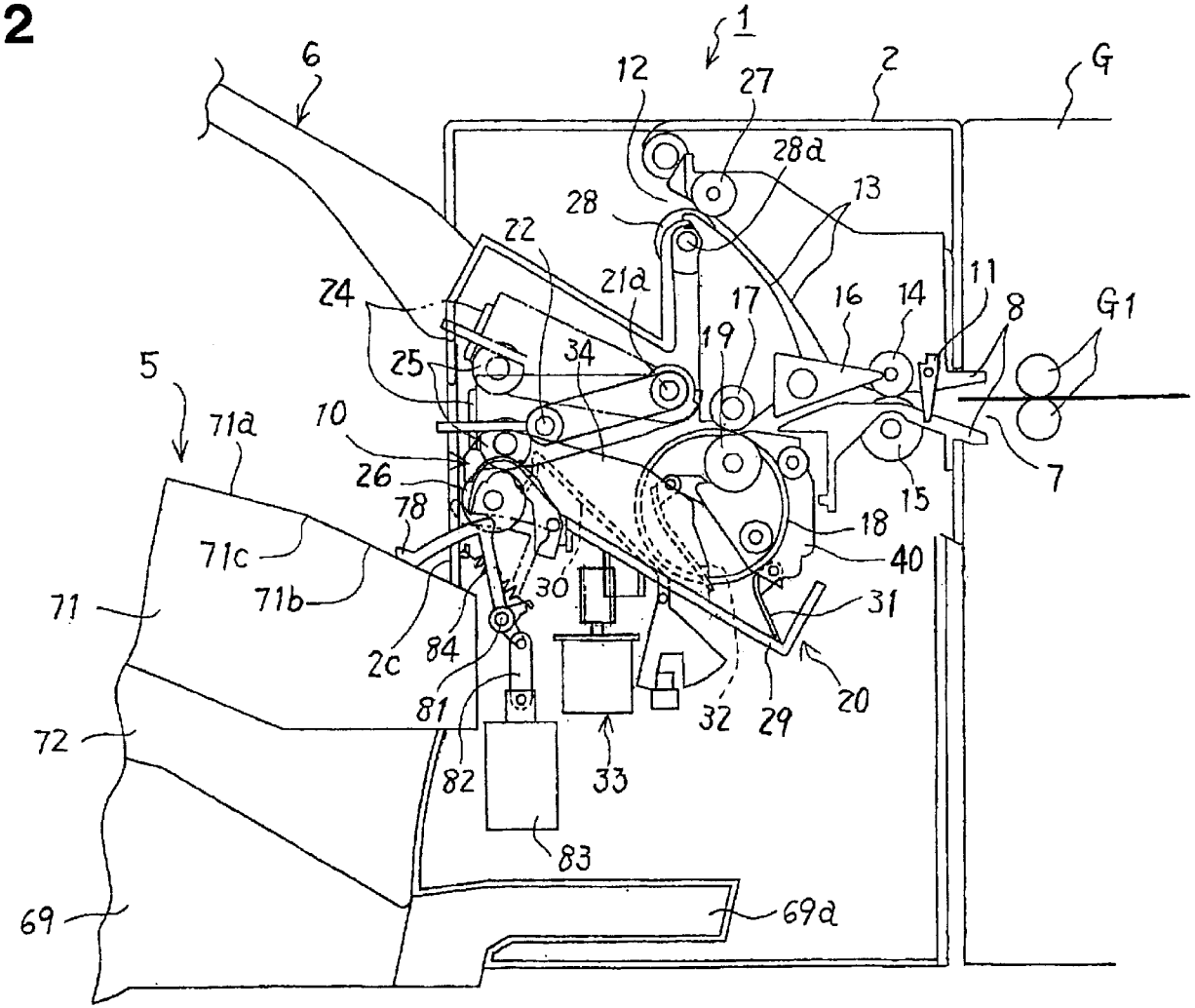
FIG. 2 is a front sectional view schematically showing an inner mechanism of the apparatus in FIG. 1.
Figure 3:
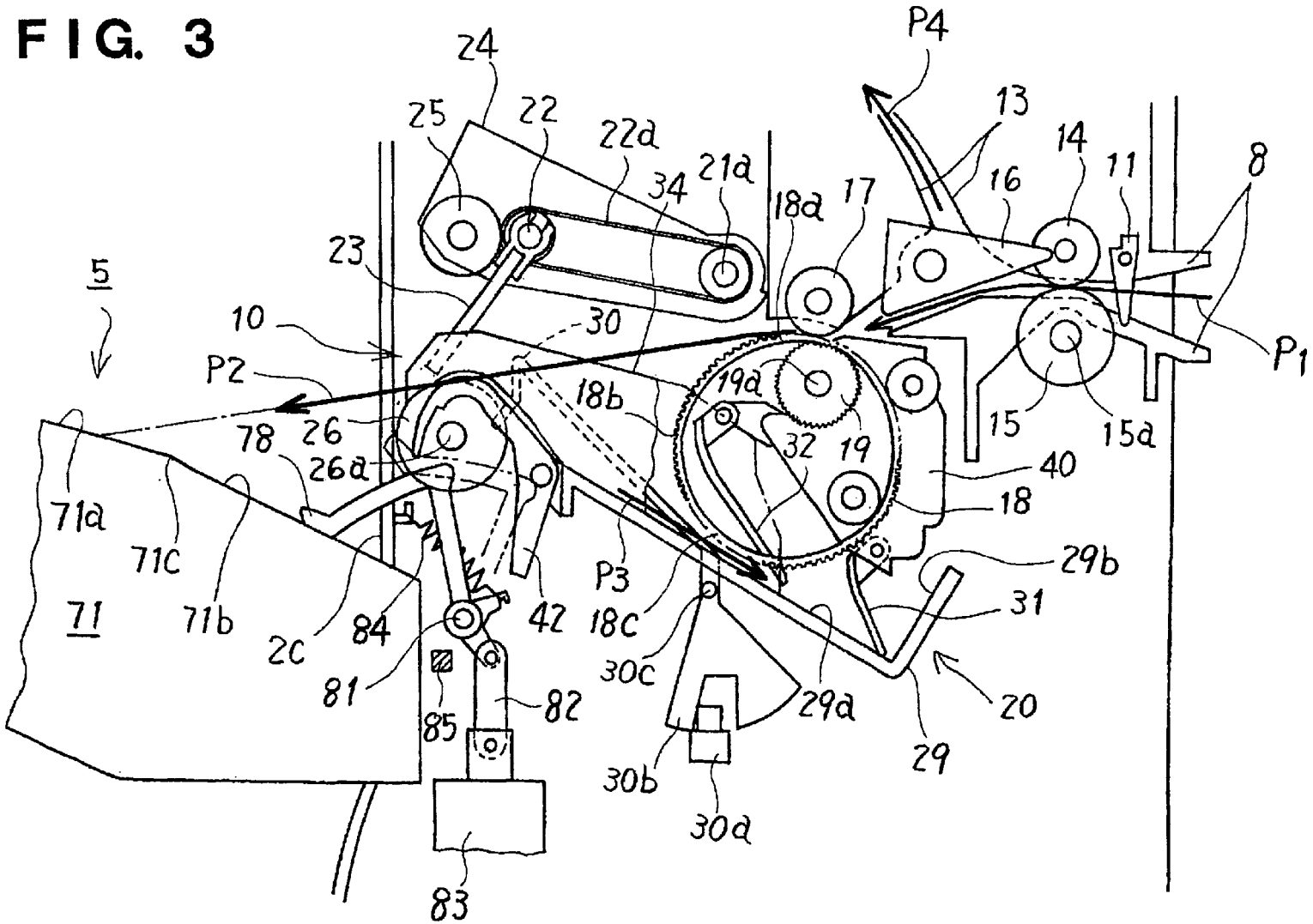
FIG. 3 is a magnified view of a part of FIG. 2.

In FIG. 1, FIG. 2, and FIG. 3, a finishing apparatus 1 as a sheet receiving apparatus is disposed adjacent to an image forming apparatus G, such as a copy machine and a printing machine. In this case, it is desirable to detachably attach the finishing apparatus 1 to the apparatus G.

The finishing apparatus 1 is formed of a main apparatus 2; a staple unit 3 attached to one side frame 2*a* of the main apparatus 2; a driving transmission system 4 (refer to FIG. 9 and FIG. 10), described later, disposed in the other side frame 2*b* of the main apparatus 2; an inlet 7 into which image-formed sheet S ejected from the image forming apparatus G is supplied; an ejection port 10 formed on a surface opposite to the inlet 7; a piling tray 5, which is projected from a front of the main apparatus 2 and stacks the sheet S ejected from the ejection port 10; and an escape tray 6 which is located above the piling tray 5 and holds the sheet ejected from a second ejection port 12.

Also, as shown in FIG. 3, inside of the main apparatus 2, there are provided a first transfer path P1 for leading the sheet S from the inlet 7 to an interior; a second transfer path which extends from the first transfer path P1, directly passes through the ejection port 10, and reaches the piling tray 5 through an ejection path; a third transfer path P3 which is spaced away from the second transfer path P2 with a level difference and switches the transferring direction backward to transfer the sheet S into a process tray 29 as a temporary placing tray for temporarily holding the sheet S; and a fourth transfer path P4 which is diverged from the middle of the first transfer path P1 and leads the sheet S to the second ejection port 12.

Namely, there are provided a "pass-through mode" by which the sheet S is transferred from the first transfer path P1, passed through the second transfer path P2, and directly ejected on the piling tray 5; a "staple mode" by which the sheet S is switched backward to be transferred from the second transfer path P2 along the third transfer path P3 to place and align a plurality of sheets on the process tray 29, and after binding or stapling process of the sheets by the staple unit 3, a set of the sheets is ejected on the piling tray; and an "escape mode" by which the sheet S is transferred from the first transfer path P1 to the fourth transfer path P4, and ejected on the escape tray 6.

The first transfer path P1 is provided with a transfer guide 8 for guiding a transfer of the sheet S supplied from the inlet 7; an inlet sensor 11 for detecting that the sheet is supplied; a transfer driving roller 15 which cooperates with a driven roller 14 to feed the sheet S to a further downstream side; and a rotary type flapper 16 for switching the transfer path in case of guiding the sheet S transferred by the transfer driving roller 15 toward endless transfer belts 18 as sheet transferring means in front thereof, and in case of guiding the sheet S toward the fourth transfer path P4.

The endless transfer belts 18 transfer the sheet S to the second transfer path P2 in cooperation with the driven rollers 17. Incidentally, the transfer belt 18 is formed of a ring-shaped endless belt made of rubber, and is rotated by a belt driving roller 19 fixed to a driving shaft 19*a* while it is deformable and flexible in a vertical direction and a direction intersecting thereto in FIG. 2 and FIG. 3.

Below the endless transfer belts 18, a process tray unit 20 is disposed. The process tray unit 20 is provided for temporarily placing the sheets S in order to staple every predetermined number of sheets by the staple unit 3 by sequentially placing the sheets S.

Incidentally, although the embodiment shows one for stapling a predetermined number of sheets S, it can be adopted to one for temporarily placing the sheets in order to punch sheets, or in order to align a plurality of sheets S before ejecting the same on the piling tray 5.

Also, above the second transfer path P2, there is disposed a rotating unit 24 for rotationally moving vertically or up and down around a paddle driving roller shaft 21*a* as a shaft fulcrum. The rotating unit 24 is located at a lower position which is a position shown by solid lines in FIG. 2 in case the sheet S from the first transfer path P1 is directly ejected onto the piling tray 5 through the ejection port 10, or in case a plurality of sets of the sheets in the process tray unit is ejected onto the piling tray 5. In case the sheet S is guided to the third transfer path P3 in the process tray 11, the rotating unit 24 is located at an upper position shown by two-dotted chain lines in FIG. 2.

In the rotating unit 24, there are disposed rubber paddles 23 provided at a paddle rotational shaft 22 which is subject to rotation by rotation of the paddle driving shaft 21*a* and the paddle driving roller 21, and driven ejection rollers 25 disposed at a free end side of the rotating unit 24, in which the sheet S is provided. The driven ejection rollers 25 cooperate with ejection rollers 26 located under the ejection rollers 25 to eject the sheet S or set of the sheets S from the ejection port 10 onto the piling tray 5.

In the ejection port 10 of the main apparatus 2, there are disposed the ejection rollers 26 which face the ejection driven rollers 25 and are rotated by the driving shaft 26*a*.

Beneath the ejection rollers 26 in the figures, a sheet striking surface or sheet regulating surface 2*c* as a sheet end regulating member, which regulates end rims of the sheets S stacked on the piling tray 5, is formed integrally with a front frame of the main apparatus 2. There are disposed sheet pressing levers 78 which are disposed adjacent to the ejection rollers 26 in the sheet striking surface 2*c*, respectively, and which retract or project from an upper position of the sheet striking surface 2*c* toward the piling tray 5. The sheet pressing levers 78 move to project toward the piling tray 5 every time the sheet S or the set of the sheets S is ejected by the ejection rollers 26 and the driven ejection rollers 25.

Therefore, though explained in detail later, the sheet pressing levers 78 press the end rims of the stacked sheets to thereby improve the ability of stacking the sheets S to the piling tray 5, and at the same time, prevent jamming of the subsequently ejected sheet S (sheet jam) caused when the end rim of the sheet S stacked on the piling tray 5 is curled and abuts against the forward end of the sheet S subsequently ejected.

Incidentally, in the embodiment, the sheet pressing levers 78 are driven by a pressing lever solenoid 83 located in a rear surface side of the sheet striking surface 2*c* such that the levers are projected from or retracted into the sheet striking surface 2*c*.

The fourth transfer path P4 is provided with transfer guides 13, and used in case post processing by stapling function, sorting function, or the like is not made to the image-formed sheet S, or in case of a special sheet with an irregular size. The fourth transfer path P4 is provided with second ejection rollers 28 which cooperate with driven rollers 27 to eject the sheet S from the second ejection port 12 to the escape tray 6.

The aforementioned is a schema of the structure of the main apparatus 2, and structures of the respective units and the respective mechanisms will be further explained by using FIG. 2 through FIG. 7 in the following.

Figure 4:
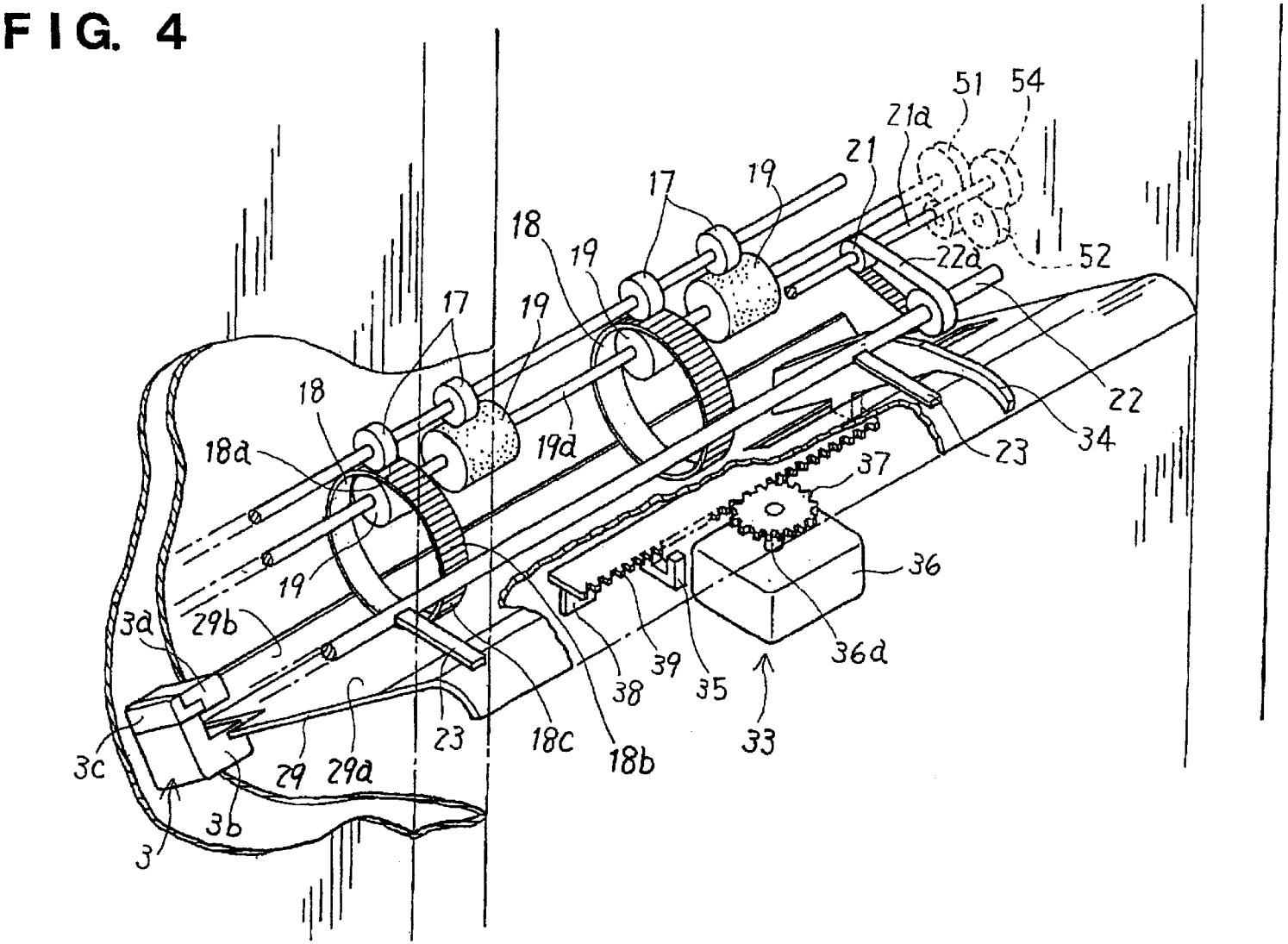
FIG. 4 is a schematic perspective view showing a part of a sheet temporary placing tray in the apparatus in FIG. 1.

As clearly shown in FIGS. 3 and 4, the process tray unit 20 is provided with the process tray 29 as a temporary placing tray for placing the sheet temporarily in order to operate the stapling process; a sensor lever 30 which detects the sheet S transferred on the process tray 29; sheet pressers 32 as sheet pressing means abutting against an upper surface of the uppermost sheet S on the process tray 29, wherein the sheet pressers are positioned along a transfer direction of the sheet S and disposed at two locations in front and rear direction; and an aligning plate 34 as aligning means for aligning the sheet S stacked on the process tray 29.

In the process tray 29, a sheet placing section 29*a* inclined upwardly to have a direction of ejecting a set of sheets after stapling at a distal end thereof is integrally formed with a process sheet forward end regulating piece 29*b* as sheet regulating means which stands from a rear end of the sheet placing section 29*a* to engage with a side rim of the sheet S on the sheet placing section 29*a*.

Also, although a width of the process tray 29 is larger than that of the sheet S with the largest sheet size to be sent into the main apparatus 2, a length of the sheet transferring direction, that is, a distance from the inlet 7 to the ejection port 10 can be shorten irrespective of the sheet size. This is because of the structure such that the sheet can be placed to extend over the process tray 29 and the piling tray 5.

One end side of the sensor lever 30 extends in the second transfer path P2 in the side of the ejection port 10, and is supported freely rotatably by a sensor rotating shaft 30*c* under the process tray 29. The other end side of the sensor lever 30 includes a sensor flag 30*b* detected by a sheet presence sensor 30*a*. When there is no sheet S, as shown in FIG. 2 and FIG. 3, the one end side of the sensor lever is separated from the sheet placing section to extend in the second transfer path P2.

The sensor lever 30 detects conditions of the sheet S when the sheet S is not transferred in the second transfer path P2, and the condition of the sheet S when the sheet is not placed on the sheet placing section 29*a* of the process tray 29.

Therefore, in the condition that the sheet S is not placed on the sheet placing section 29*a*, even in case the sheets are transferred from the first transfer path P1, directly pass through the second transfer path P2, and are stacked on the piling tray 5 sheet by sheet, the sensor lever functions also as a transfer pass sensor of the sheet S wherein a rear end edge of the sheet S is ejected.

Also, in case a set of the sheets is ejected from the process tray 29, the sensor lever can detect it as a sensor for ejecting and passing the set of the sheets S. Incidentally, a passing detection signal by the sensor lever 30 is utilized as an operating signal for the pressing lever solenoid 83 which actuates the sheet pressing lever 78 described above.

In the side of the ejection port 10 of the sheet placing section 29*a*, there is provided a sheet bending guide 42 located slightly above outer peripheral surfaces of the ejection rollers 26.

Incidentally, although the finishing apparatus 1 switches backwardly the sheet S from the second transfer path P2 to the third transfer path P3 and places the sheet S on the process tray 29, the condition of the sheet S placed at this time is such that the sheet S is extended over the process tray 29 and the piling tray 5 since the process tray 29 is set much shorter than the transferring direction length of the sheet S, as described above.

Thus, in case of shifting the sheet S on the process tray 29 to the width direction substantially perpendicular to the transferring direction in order to align, it is desirable not to make the sheet S contact the ejection rollers 26 made of a high friction member, such as a rubber member, and it is also desirable to bend the sheet S into an angle shape having an ejection roller portion as an apex.

On the other hand, even when the sheet S is ejected directly onto the piling tray 5 from the first transfer path P1 through the second transfer path P2 without placing the sheet S on the sheet placing section 29*a*, until the forward end of the sheet S passes through the ejection rollers 26, it is desirable to keep the noncontact condition between the ejection rollers 26 and the sheet S. In order to attain the aforementioned, the sheet bending guide 42 is provided.

Incidentally, the sheet bending guide 42 interlocks with the vertical movement of the rotating unit 24, and when the rotating unit is located at the lower position shown by solid lines in FIG. 2, the sheet bending guide 42 is located inside the outer peripheral surfaces of the ejection rollers 26.

As shown in FIG. 4, an aligning unit 33 includes the aligning plate 34 disposed in a direction intersecting to the direction of transferring the sheet S; an aligning plate driving motor 36; a pinion gear 37 fixed to an output shaft 36*a* of the aligning plate driving motor 36; a rack gear 39 provided at a bottom surface of the aligning plate 34 and engaging the pinion gear 37; an aligning plate position detecting sensor 35 for detecting a position of the aligning plate 34, and an aligning plate flag 38 traversing the sensor and formed integrally with the rack gear 39, wherein the aligning plate position detecting sensor 35 and the aligning plate flag 38 are located under the rack gear 39.

Therefore, every time the sheet S is transferred to the process tray 29 along the third transfer path P3, the aligning plate 34 is moved toward a direction substantially vertical to the direction of transferring the sheet S by rotational driving of the aligning plate driving motor 36 so as to abut against the sheet S, and performs the operation of aligning the sheet S by allowing the sheet S to abut against the main apparatus side frame 2*a*, to which the staple unit 3 located at a position facing the direction of moving the aligning plate 34 is attached.

Incidentally, although only one side of the width direction of the sheet S is provided with the aligning plate 34 in this embodiment, the aligning operation can be performed such that the sheet S is sandwiched by a pair of the aligning plates, which approach to and separate from each other, at both sides of the width direction of the sheet S.

Here, the endless transfer belts 18 are explained. As explained above, the endless transfer belts 18 transfer the sheet S toward the second transfer path P2 in cooperation with the driven rollers 17. Also, in the third transfer path P3, the endless transfer belts 18 engage with the sheet S to transfer thereof toward the sheet forward end regulating piece 29*b*.

Namely, as shown in FIG. 3 and FIG. 4, each endless transfer belt 18 has a surface engaging with the sheet S in a fine tooth shape, wherein 18*a* shown in the figures functions as a sheet take-in transfer section which takes in the sheet from the first transfer path P1; 18*b* functions as a dropping section for dropping a transferring direction rear end of the sheet S from the second transfer path P2 to the third transfer path P3 in cooperation with the paddle 23, described later; and 18*c* also functions as a sheet feed-in section for transferring the sheet S in the third transfer path P3.

Since the endless transfer belts 18 are made of a deformable, flexible material, even if the sheets S are stacked consecutively on the sheet placing section 29*a*, the sheet feed-in section 18*c* is elevated in accordance with the thickness of the sheets S.

Referring now to the positional relationship between the endless transfer belts 18 and the aligning plate 34, as shown in FIG. 3 and FIG. 4, the sheet feed-in sections 18*c* of the endless transfer belts 18 are located within a range of the transferring direction length of the aligning plate 34. The aligning plate 34 moves and shifts the sheet S in the width direction after the end rim of the sheet S reaches the piece 29*b* for regulating the forward end of the sheet S, and at the time of the aligning, the sheet S and the sheet feed-in section 18*c* are in contact with each other. Therefore, if the sheet feed-in sections 18*c* are located outside the aligning plate 34, a force for rotating the sheet S around the sheet feed-in sections 18*c* works and aligning is not properly performed. In order to prevent this improper aligning, the sheet feed-in sections 18*c* are disposed inside the transferring direction length of the aligning plate 34, and accordingly, the entire transfer direction length of the main apparatus 2 can be shorten and made compact.

Incidentally, although the endless transfer belt 18 in a ring shape is shown in the embodiment shown in the drawings, instead of this, there can be used a paddle-shaped one which is deformable in accordance with the thickness of the sheets even when the sheets S are stacked, or a relatively large roller formed of a soft material, such as a sponge material.

Next, the sheet pressers 31 and 32 disposed on sheet placing section 29*a* will be explained with reference to FIG. 5 and FIG. 6.

As described above, the sheets S placed on the process tray 29 are sequentially transferred along the third transfer path P3 by means of the endless transfer belts 18 and placed onto the sheet placing section 29*a*. At this time, the sheet S is transferred while being pressed against the side of the sheet placing section 29*a* by the first sheet presser 31 and the second sheet presser 32, which are freely rotatably attached to a support member 40 above the process tray 29. At the same time, even after the end rim of the sheet S reaches the sheet forward end regulating piece 29*b* of the process tray 29, the sheets S are placed with good alignment without having the sheet S curled to block the transfer-in of the subsequent sheet S, and the post processing, such as stapling, is applied to the sheets S.

Namely, in the first sheet presser 31, a base end portion 31*a* thereof enters the support member 40 and is freely rotatably attached to a support shaft 40*a* of the support member 40; and a distal end 31*b* of the first sheet presser 31 is suspended at a position close to the sheet forward end regulating piece 29*b* of the processing tray and in contact with the sheet placing section 29*a*. Also, the distal end 31*b* of the first sheet presser 31 is positioned such that a part of the distal end overlaps the sheet forward end regulating piece 29*b* of the process tray 29. This overlapping is to prevent the end rim of the sheet S from passing between the distal end 31*b* and the sheet forward end regulating piece 29*b*.

Next, in the second sheet presser 32, a base end portion 32*a* thereof is freely rotatably attached to a second support shaft 40*c* of a support piece 40*b* attached to the support member 40, and a distal end 32*b* of the second sheet presser 32 is suspended from an inter space between the endless transfer belts 18 toward the sheet placing section 29*a*.

Figure 5:
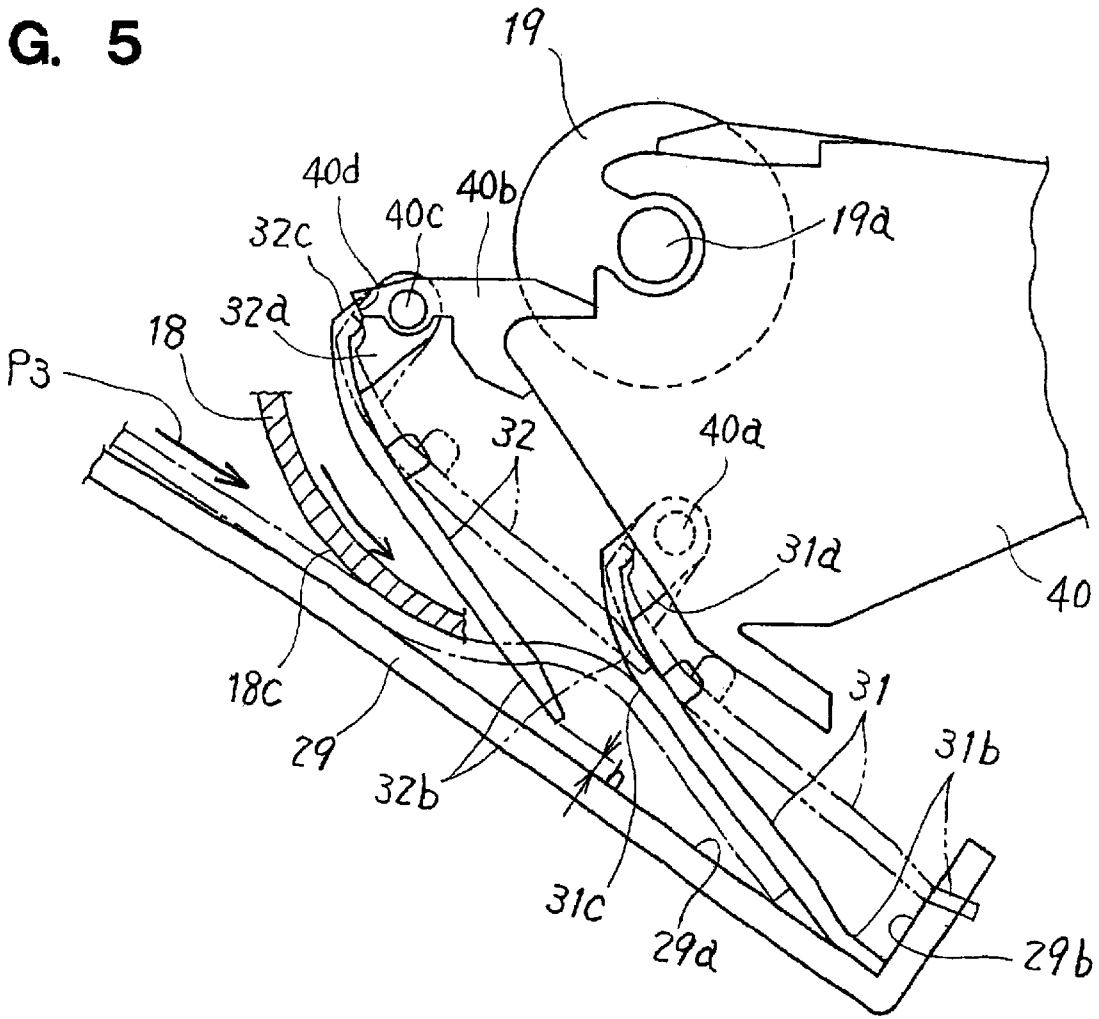
FIG. 5 is a front sectional view schematically showing sheet pressing means on the sheet temporary placing tray in the apparatus in FIG. 1.

Also, as shown in FIG. 5, when a stopper portion 32*c* of the second sheet presser 32 abuts against a regulating portion 40*d* provided in the support piece 40*b*, the second sheet presser 32 is positioned by keeping the distance h between the sheet placing section 29*a* and the second sheet presser 32. Therefore, in the second sheet presser, until a thickness of the sheets S stacked on the sheet placing section 29*a* becomes h or higher, the distal end 32*b* does not contact the sheet S.

As described above, the reason why the distal end 32*b* of the second sheet presser 32 is separated from the sheet placing section 29*a* is to decrease the resistence and damage to the sheets S when the number of the sheets S is small. Also, when sheets S are a predetermined number (for distance h or more), or when an upward curl of the sheets S in excess of the distance h takes place, the distal end of the second sheet presser 32 comes into contact with the sheet S to press a set or bundle of sheets.

Therefore, in case the sheets S placed on the sheet placing section 29*a* are a few or a curl thereof is small, firstly, the sheets S are pressed only by the first sheet presser 31. When the number of the sheets placed is increased, or a big curl occurs, the sheets S are also pressed by the second sheet presser 32.

Also, when the sheet S is largely curled as the sheet S shown by a single-dotted chain line in FIG. 5, the distal end 32*b* of the second sheet presser 32 abuts against a rear portion 31*c* of the first sheet presser 31 to engage therewith. The reason for this is to rapidly eliminate the curl by applying the weight of the first sheet presser 31 to the distal end 32*b* of the second sheet presser 32 when the curl larger than the predetermined one occurs to the sheet S.

By the way, the second sheet presser 32, in which the distal end 32*b* is spaced away from the sheet placing section 29*a*, is located at the upper stream side in the transfer direction than first sheet presser 31 when the sheet S is transferred into the process tray 29. According to this embodiment, in case the number of transferred sheets S is small, the sheets S are pressed only by the first sheet presser 31 in the vicinity of the sheet forward end regulating piece 29*b*; and in case the number of transferred sheets S is increased, both the second sheet presser 32 and the first sheet presser 31 conduct the operation of pressing the sheet S, so that the pressing force with respect to the sheets can be increased in accordance with increase in the number of transferred sheets S, resulting in improving the performance of placing and stacking the sheets.

Figure 6:
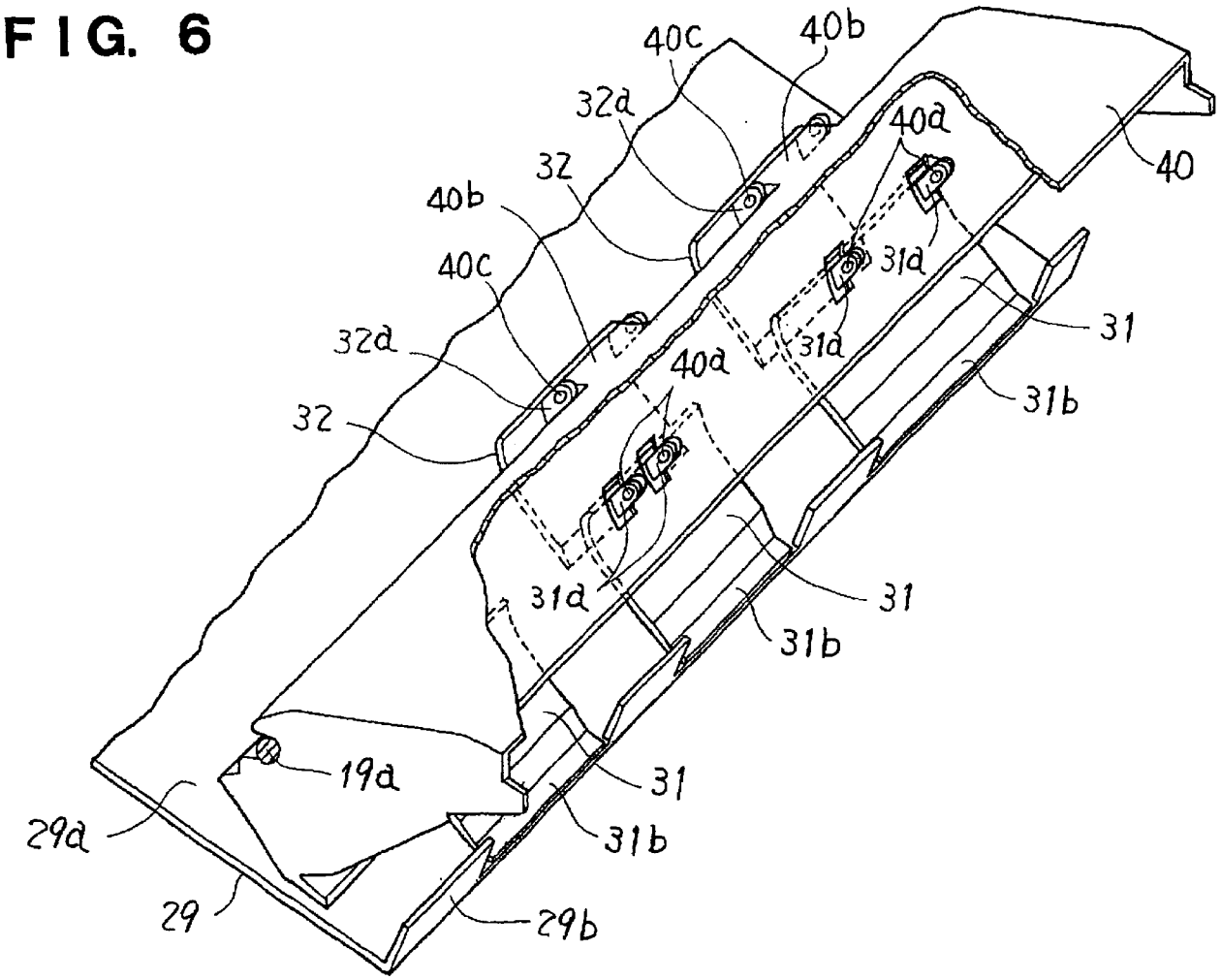
FIG. 6 is a schematic perspective view showing the sheet pressing means on the sheet temporary placing tray in FIG. 5.

Further, as shown in FIG. 6, the first sheet presser 31 and the second sheet presser 32 are arranged in rows in the width direction of the sheet S, so as to mostly hold one end side of the sheet placed on the sheet placing section 29*a*. Therefore, a post processing, such as fastening or stapling by the staple unit 3, can be applied to end portions of the sheets in the condition that the sheets are properly aligned.

Incidentally, in the above embodiment, in a condition that the sheet S is not placed on the sheet placing section 29*a*, the distal end 31*b* of the first sheet presser 31 contacts the sheet placing section 29*a*. However, the distal end 31*b* may not contact the sheet placing section 29*a*, and in this case, it is only required that a distance between the distal end 31*b* of the first sheet presser 31 and the sheet placing section 29*a* is set smaller than the distance h between the distal end 32*b* of the second sheet presser 32 and the sheet placing section 29*a*.

Also, although the first sheet pressers 31 and the second sheet pressers 32 are arrange in two rows in the sheet transferring direction, they can be arranged in three or four rows, and it is possible to arranged them in the same row in view of changing the pressing force with respect to the sheet S.

Figure 7:
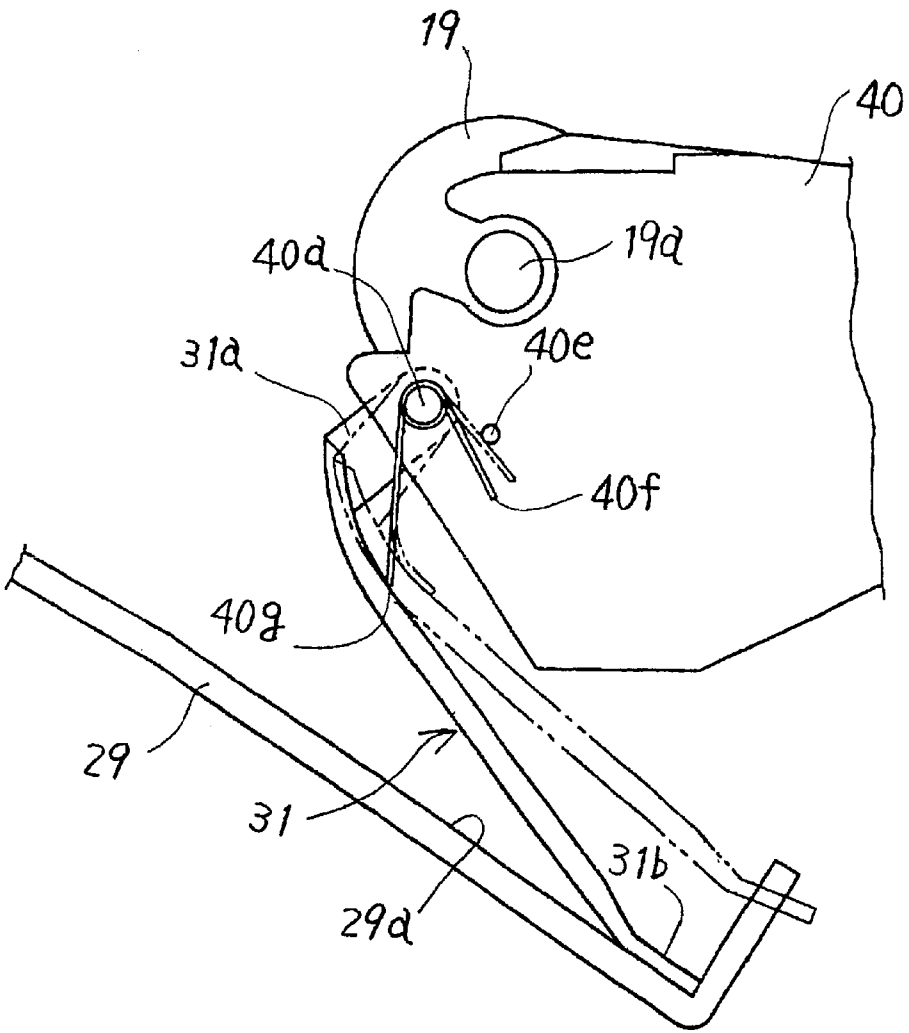
FIG. 7 is a schematic, front sectional view showing another embodiment of the sheet pressing means in FIG. 5.

Further, as shown in FIG. 7, the second sheet pressers 32 may be omitted, and coil springs 40*f* can be interposed between the support member 40 and the first sheet pressers 31. One end of the coil spring 40*f* is positioned at a spring pin 40*e* provided in the support member 40, and a spring abutting portion 40*g* at the other end of the coil spring 40*f* is positioned in a rear surface side of the first sheet presser 31. Therefore, the spring coil 40*f* can be structured such that when the number of the placed sheets S is a few, an elastic force by the coil spring 40*f* does not work, and as the number of the placed sheets S is increased, the elastic force by the coil spring 40*f* is gradually increased to thereby increase the force for pressing the sheets S.

To the sheets S placed on the process tray 29, the stapling process is applied by the staple unit 3, and the staple unit 3 in the embodiment is disposed to incline with substantially the same angle as that in the sheet placing section 29*a* of the process tray 29, and fixed to the side frame 2*a* as shown in FIG. 1 and FIG. 4. From the main apparatus frame 2 toward the sheet placing section 29*a* located therein, the staple unit is provided with a head section 3*a* for driving staples in the forward end portions of the sheets S, and an anvil section 3*b* for bending the staples driven by the head section 3*a*. Also, a replaceable cartridge 3*c* for holding staples is provided at a rear surface side of the staple unit, that is, an external side of the main apparatus frame 2.

Incidentally, although the staple unit 3 is structured that the staple is driven from the upper surface side of the sheet on the sheet placing section 29*a*, the staple unit 3 can be structured such that the vertical relation between the head section 3*a* and the anvil section 3*b* is reversed, and the staple is driven from a lower surface side of the sheet S.

Figure 8:
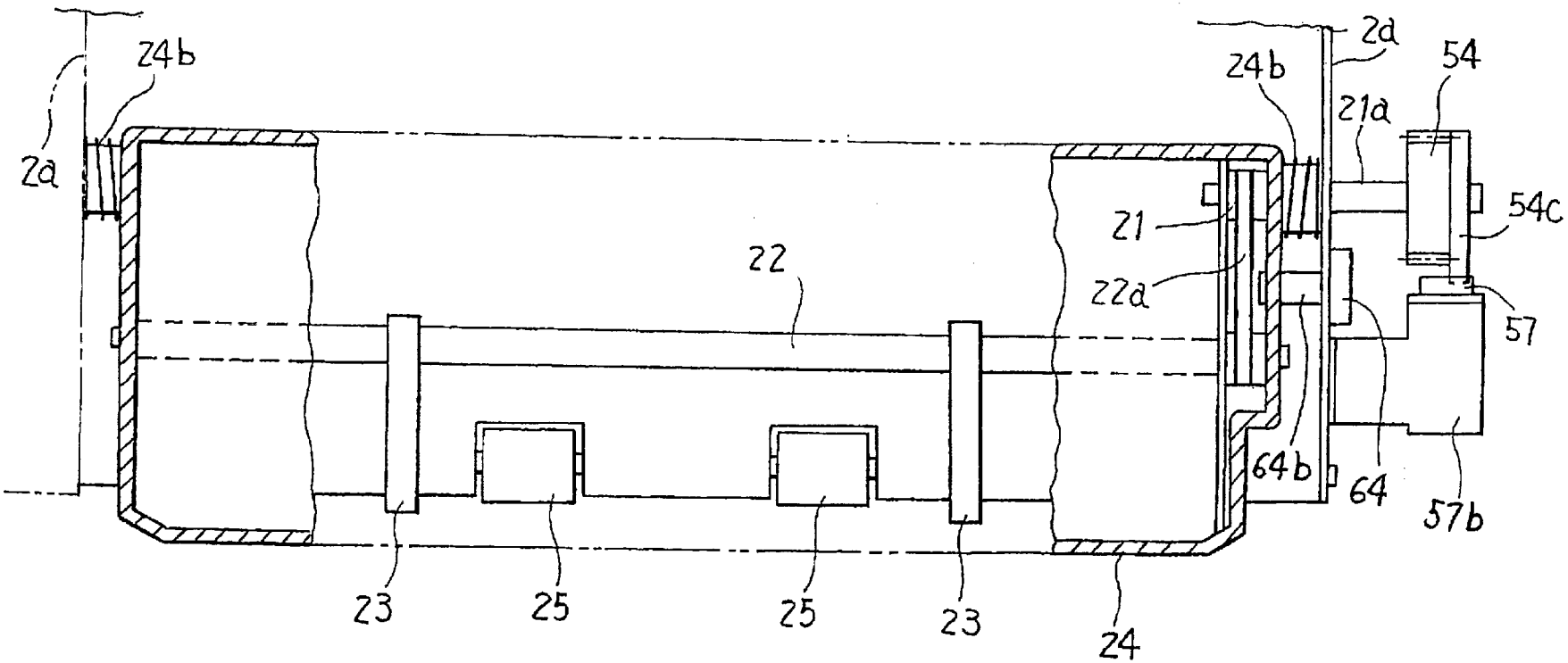
FIG. 8 is a plan view showing a schematic structure of a rotating unit in the apparatus in FIG. 1.

Next, in FIG. 3, the rotating unit 24 located above a sheet ejection port side of the process tray 29 is explained. As shown in the plan view in FIG. 8, the rotating unit 24 includes the paddles 23; the paddle rotational shaft 22 for rotating the paddles 23; a paddle driving belt 22*a* for transmitting the drive to the paddle rotational shaft 22; the paddle driving roller 21 for driving the paddle driving belt 22*a*; and the driven ejection rollers 25 which are disposed at the ejection port 10 and eject the sheet S in cooperation with the ejection rollers 26 in the side of the main apparatus frame 2. The paddle driving roller 21 is rotated by the paddle driving shaft 21*a* driven to rotate by a paddle drive transmission gear or driven gear 54 that is a part of the driving transmission system 4 provided at the main apparatus side frame 2*a*. Also, the rotating unit 24 swings up and down between the position close to the ejection roller 26 and the position spaced away from the sheet ejection roller 26 by having the paddle driving shaft 21*a* as a supporting point. The vertical swinging movement is performed by engaging an elevating pin 64*b*, which is projected from an elevating lever 64 disposed at the driving transmission system 4, with the rotating unit 24. The rotating unit 24 is provided at the supporting point of the paddle driving roller shaft 21*a*, and always urged toward a lower side of the ejection roller 26 side by a rotating unit spring 24*b*, one end of which abuts against the main apparatus frame 2, and the other end of which abuts against a frame of the rotating unit 24. However, by resisting against the urging force, the rotating unit 24 is controlled to swing up and down by means of the elevating lever 64.

The main apparatus 2 has the "pass-through mode" by which the sheet S is transferred from the first transfer path P1, passed through the second transfer path P2, and directly ejected on the piling tray 5; the "staple mode" by which the sheet S is switched backward to be transferred from the second transfer path P2 along the third transfer path P3 so as to place and align a plurality of sheets on the process tray 29, and after a stapling process by the staple unit 3, a set of the sheets is ejected on the piling tray; and the "escape mode" by which the special sheet S is diverged from the first transfer path P1, transferred along the fourth transfer path P4, and ejected on the escape tray 6.

A system for driving the transfer driving rollers 15, the endless transfer belts 18, the ejection rollers 26, the paddles 23, the rotating unit 24, the second ejection rollers 28, or the like, which are disposed from these first transfer path P1 to the fourth transfer path P4, will be explained in the following.

Figure 9:
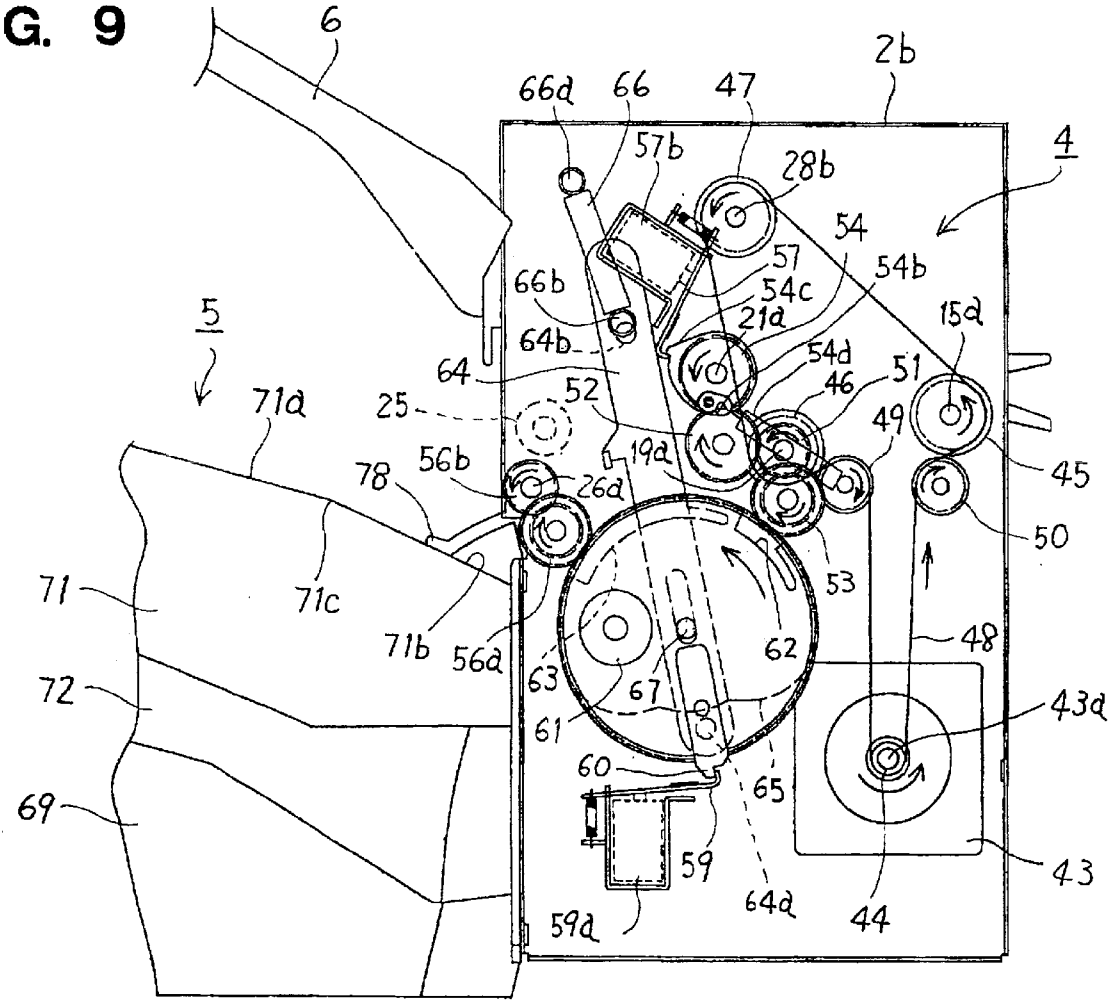
FIG. 9 is a front sectional view schematically showing a driving transmission system in the apparatus in FIG. 1.
Figure 10:
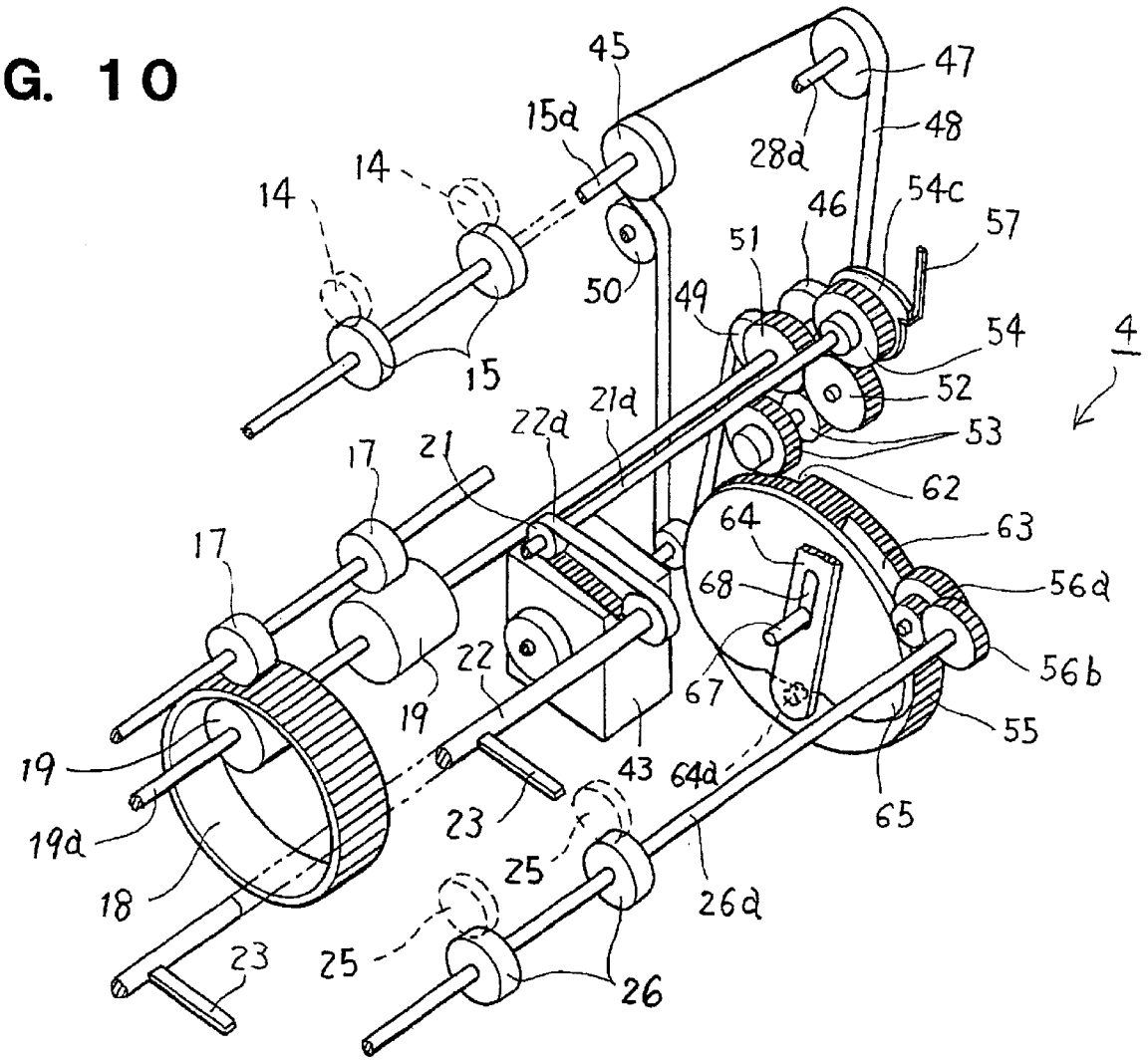
FIG. 10 is a schematic perspective view showing a part of the driving transmission system in FIG. 9.

As shown in FIG. 9 and FIG. 10, the driving transmission system 4 of the embodiment includes a single driving motor 43; an output pulley 44 which is provided at an output shaft 43*a* of the single driving motor 43 and rotates in a counterclockwise direction; a driving pulley 45 which is provided at a rotational shaft 15*a* of the transfer driving roller 15 disposed in a side of the inlet 7; a driving pulley 47 provided at a rotational shaft 28*a* of the second ejection roller 28; a driving pulley 46 provided at the driving shaft 19*a* of the driving roller 19 for rotating the endless transfer belt 18; a rotating belt 48 which transmits driving from the output pulley to the driving pulleys 45, 46 and 47; a timing gear 55 having a large diameter and coupling through a driven transmission gear 53 engaging with a transmission gear 51 provided at the driving shaft 19*a* which is coaxial to the driving pulley 46; a transmission gear 56*b* which is provided at the rotational shaft 26*a* of the ejection rollers 26 and coupled with the timing gear 55 through an intermediate gear or ejection roller driving transmission gear 56*a*; a paddle driving transmission gear 54 provided at the paddle driving shaft 21*a*, which supports the rotating unit 24 to freely swing up and down and rotates the paddle driving roller 21, and including a lock plate 54*c* on an outer periphery thereof connected to a driven transmission gear 52 and the transmission gear 51 coaxial to the driving pulley 46; the paddle driving belt 22*a* which connects the paddle driving roller 21 with the paddle rotational shaft 22 for supporting the paddle 23; a cam 65 provided at the timing gear 55; and the elevating lever 64 which engages with the rotating unit 24 by the pin 64*b* and allows the rotating unit 24 to swing up and down by the rotation of the cam 65.

In the drawings, numerals 49 and 50 are tension rollers for providing the tension to the rotating belt 48.

When the sheet S is fed from the inlet of the main apparatus 2 and the forward end of the sheet S is detected by the inlet sensor 11, the apparatus becomes the operation condition. Accordingly, the transfer driving motor 43 is actuated, and by means of the rotating belt 48, the transfer driving roller 15 coupled to the driving pulley 45, the second ejection roller 28 coupled to the driving pulley 47, and the driving roller 19, which is coupled to the driving pulley 46 and drives the endless transfer belt 18, keep rotating in the sheet forwarding (transfer direction downstream side) direction.

In passing, in case the process for the sheets S is the "pass-through mode", without driving to rotate the paddle 23, the timing driving gear 55 is rotated, and by this rotation, the elevating lever 64 is moved downwardly in the drawings, so that the rotating unit 24 is also moved to the side of the ejection rollers 26 to be pressed against the driven ejection rollers 25 inside the rotating unit 24. At the same time, the timing driving gear 55 rotates the ejection rollers 26 through the intermediate gear 56*a* and the transmission gear 56*b*, so as to eject the sheets S along the second transfer path P2 onto the piling tray 5 sheet by sheet.

On the other hand, in case of the "staple mode", when the rear end of the sheet S passes through the endless belt driving roller 19 and the driven roller 17, the paddle 23 is rotated in a direction opposite to the sheet transfer direction (the direction opposite to the driving roller 19), so that the sheet S is fed from the second transfer path P2 along the third transfer path P3 into the process tray 29. When the end rim of the sheet S reaches the sheet forward end regulating piece 29*b* of the process tray 29, the aligning plate 34 is moved to press the sheet S against the main apparatus side frame 2*a*. This operation is repeated until the predetermined number of the sheets S are stacked, and thereafter, the staple unit 3 is actuated to carry out the operation for stapling the set of the sheets on the process tray 29. After this post process is carried out, the timing driving gear 55 is rotated, and the elevating lever 64 is moved downwardly in the drawings by this rotation, so that the rotating unit 24 is also moved to the side of the ejection roller 26 to put the driven ejection rollers 25 inside the rotating unit 24 into a condition of pressing against the set of the sheets. At the same time, the timing driving gear 55 rotates the ejection rollers 26 through the intermediate gear 56*a* and the transmission gear 56*b*, so that the set of the sheets is ejected on the piling tray 5.

Here, there will be explained a drive transmission by which the paddle 23 is driven selectively.

The lock plate 54*c*, which rotates integrally with the driven gear 54 connected to the paddle driving roller shaft 21*a* for driving the paddle 23, normally stops rotating by engaging with a lock claw 57 which can be reciprocated by a solenoid 57*b*, and in this condition, a transmitting driven gear 52 is idled by a notched tooth portion 54*b* provided in the driven gear 54. Then, when the engagement between the lock plate 54*c* and the lock claw 57 is released by driving the solenoid, the driven gear 54 is rotated by the tension force of the spring 54*d* provided in the lock plate 54*c*, and in accordance with this rotation, the driven gear 54 and the transmitting driven gear 52 are engaged with each other to rotate the driven gear 54. This rotation is one rotation, and stopped when the lock plate 54*c* is engaged with the lock claw 57.

In other words, in the condition that the lock plate 54*c* is engaged with the lock claw 57, the driving from the transmitting driven gear 52 does not rotate the driven gear 54 since the notched tooth portion 54*b* faces the transmitting driven gear 52, and unless the lock claw 57 is disengaged from the lock plate 54*c*, the driven gear 54 and the paddle 23 connected thereto are not driven to rotate.

Therefore, in case of the "pass-through mode", without releasing the engagement between the lock plate 54*c* and the lock claw 57, under the condition that the paddle 23 is stopped, the rotating unit 24 is lowered to eject the sheets S onto the piling tray 5. In case of the "staple mode", when the rear end of the sheet S passes through the endless belt driving roller 19 and the driven roller 17, the lock plate 54*c* is disengaged from the lock claw 57, so that the paddle 23 can be rotated to feed the sheets S onto the process tray 29.

Next, the timing driving gear 55 for actuating the elevating lever 64 used for elevating and lowering the ejection roller 26 and the rotating unit 24 up and down will be explained.

The timing driving gear 55 includes a locked claw or engaging piece 60, which is usually engaged with a lock claw 59 capable of reciprocating by means of a solenoid 59*a* to stop the rotation of the timing driving gear 55, and is disposed at one surface (front surface in FIG. 9) of the timing driving gear 55; a weight 61 for rotating the timing driving gear 55 in a counterclockwise direction when the engagement between the lock claw 59 and the locked claw 60 is released; the notched tooth portions 62 and 63 for idling the driven transmission gear 53 and the ejection roller driving transmission gear 56*a*; and a cam portion 65, which is engaged with a distal end 64*a* of the elevating lever 64 provided on the other surface (rear surface in FIG. 9) of the timing driving gear 55 for rotating the rotating unit 24 to reciprocate the elevating lever 64 along the axial direction. Incidentally, in the elevating lever 64, the distal end 64*a* is always urged by a spring 66 in the direction elastically contacting the cam portion 65, and in the initial condition, the distal end 64*a* and the cam portion 65 are spaced away from each other by engagement between a stopper pin 67 and a long hole 68.

Next, an example of post-processing the sheets S will be explained based on the explanatory views for explaining the operation conditions of the timing driving gear in FIGS. 11A to 11E. As described above, as the process modes for the sheets S, there are the "staple mode", "pass-through mode" and "escape mode", wherein respective methods of sending or transferring the sheets are different from the others. Firstly, the operation in the "staple mode" is explained.

This "staple mode" is a case of operating the stapling as the post process as follows: the number of the original documents processed in the image forming apparatus G is counted at the time of reading the images thereof, and based on the counted number and the prepared sets of the sheets, the stapling is carried out and the stapled sets of the sheets are stacked.

Namely, when the first sheet S in the first set is supplied to the inlet 7, the sheet inlet sensor 11 provided between the inlet 7 and the transfer roller 15 detects the sheet. According to the result detected by the sensor, the driving motor 43 starts driving, and by interlocking with the driving of the motor, the transfer rollers 15, the second ejection rollers 28 and endless transfer belt driving roller 19 are rotated through the rotating belt 48.

Figure 11A:
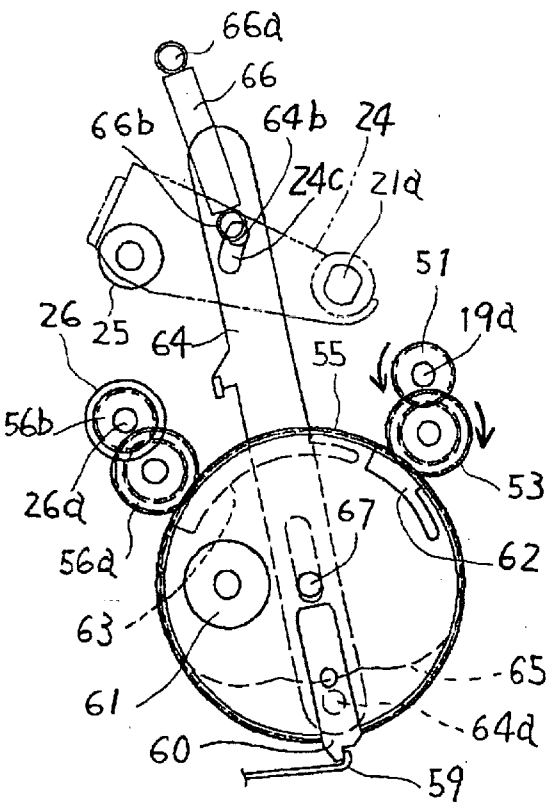
FIGS. 11A through 11E are explanatory operation condition views showing operation conditions of the driving transmission system in FIG. 9.

At this time, although the transmitting driven gear 52 is also rotated, since the driven gear 54 faces the notched tooth portion 54*b*, the driving is not transmitted, so that the driven gear 54 is in a condition of stop rotating. Also, as shown in FIG. 11A, although the driven transmitting gear 53 is rotated, the notched tooth portion 62 of the timing driving gear 55 faces the driven transmitting gear 53, and at the same time, the lock claw 59 and the engaging piece 60 are engaged with each other so that the timing driving gear 55 and the ejection roller driving transmission gear 56*a* are in the condition of stop rotating.

Also, in cooperation with the driven roller 14 and the transfer roller 15 and in cooperation with the driven roller 17 and the endless transfer belt 18, the sheet S is transferred in the first transfer path P1 inside the transfer guide 8 toward the stepped portion, and when the sheet inlet sensor 11 detects the rear end of the sheet S in the transfer direction and a predetermined time lapses, the forward end of the sheet S is located on the piling tray 5 from the ejection port 10, and at the same time, the rear end of the sheet S passes between the driven roller 17 and the endless transfer belt 18. Then, the sheet is oriented toward the third transfer path P3 by the dropping section 18*b* of the endless transfer belt 18.

In this condition, in order to allow the rotation of the paddle 23, the solenoid 57*b* is actuated to release the engagement between the lock plate 54*c* of the driven gear 54 and the lock claw 57, so that the driven gear 54 starts rotating by the spring 54*d*. By interlocking this rotation, the driven gear 54 and the transmission driven gear 52 are engaged with each other, so that the driven gear 54 provided at the paddle driving roller shaft 219 is rotated. Accordingly, the paddles 23 are rotated.

The paddles 23 return the sheet S to a direction opposite to the transferring direction heretofore, and transfer or feed the sheet S toward the sheet placing section 29*a* and the endless transfer belts 18 such that the side rim of the sheet S abuts against the forward end regulating piece 29*b* of the process tray 29.

Thereafter, the alignment plate driving motor 36 is driven to move the aligning plate 34, and the sheet S abuts against the main apparatus side frame 2*a* which is provided with the staple unit 3 located at a position facing a direction of moving the aligning plate 34, to thereby carry out the operation of aligning the sheet S.

Then, the aforementioned respective operations are carried out every time the sheet S is transferred, and after the predetermined number of the sheets is piled, the staple unit 3 is driven to carry out stapling of the sheets S.

Figure 11B:
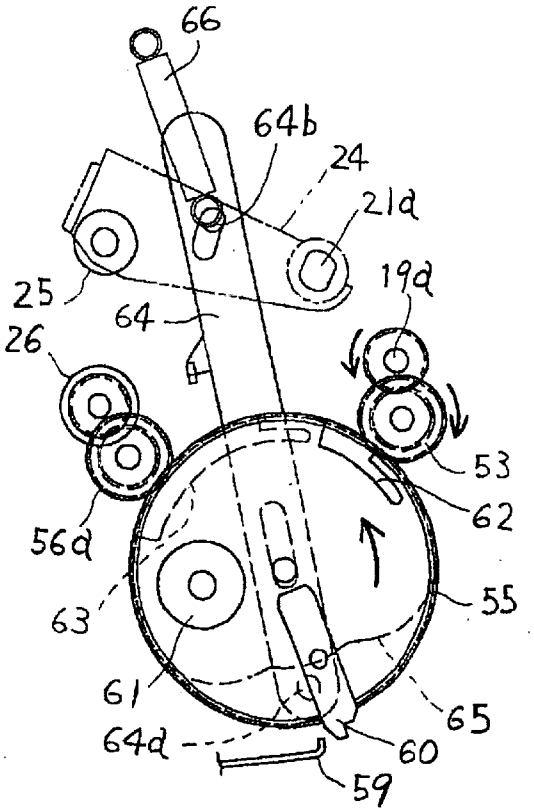

When the stapling is carried out, in order to allow the rotation of the timing drive gear 55, as shown in FIG. 11B, the timing solenoid 59*a* is actuated to release the engagement between the lock claw 59 and the engaging piece 60 of the timing driving gear 55, so that the timing driving gear 55 is rotated in a counterclockwise direction by the gravity of the weight 61.

By this rotation, the driven transmission gear 53 is disengaged from the notched tooth 62 and engaged with the timing driving gear 55, and by receiving the driving from the driven transmission gear 53, the timing driving gear 55 starts rotating seriously.

Figure 11C:
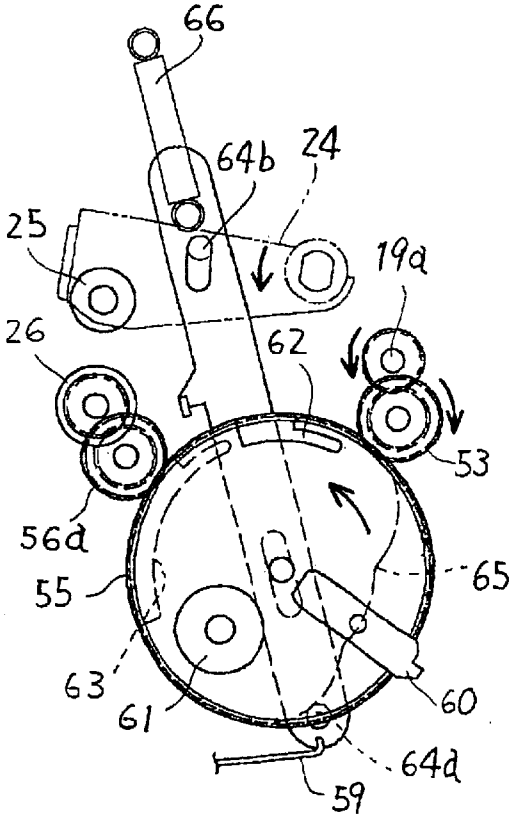

Further, as shown in FIG. 11C, the distal end cam follower section 64*a* of the elevating lever 64 located at a rear side of the timing driving gear 55 elastically contacts the cam portion 65 of the timing driving gear 55, and by the shape of the cam, the elevating lever 64 starts moving downwardly in the drawing by resisting against the urging by the spring 66 upwardly in the drawing. By the downward movement of the elevating lever 64, the elevating pin 64*b* engaging with a slit 24*c* of the rotating unit 24 is also lowered, so that the rotating unit 24 starts moving downwardly in the drawing. (Incidentally, although the slit 24*c* of the rotating unit and the elevating pin 64*b* are located in the rear side of the elevating lever 64 in FIGS. 11A to 11E, they are shown by solid lines in FIGS. 11A to 11E for the sake of explanation.)

After the rotating unit 24 starts moving downwardly, the ejection roller driving transmission gear 56*a* is disengaged from the notched tooth portion 63 of the timing driving gear 55 to engage with the timing driving gear 55, and the ejection roller driving transmission gears 56*a* and 56*b* start rotating, so that the sheet ejection roller 26 starts rotating.

Figure 11E:
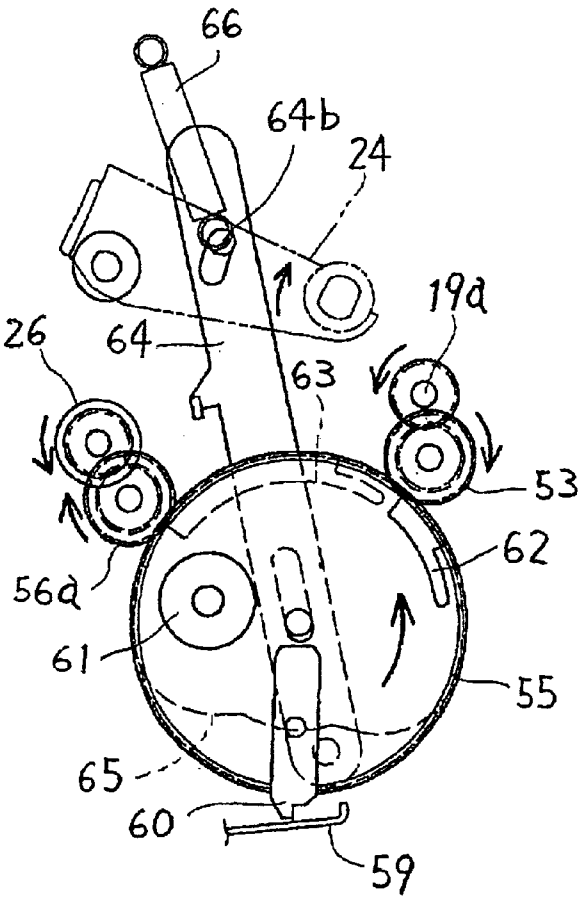
Figure 11D:
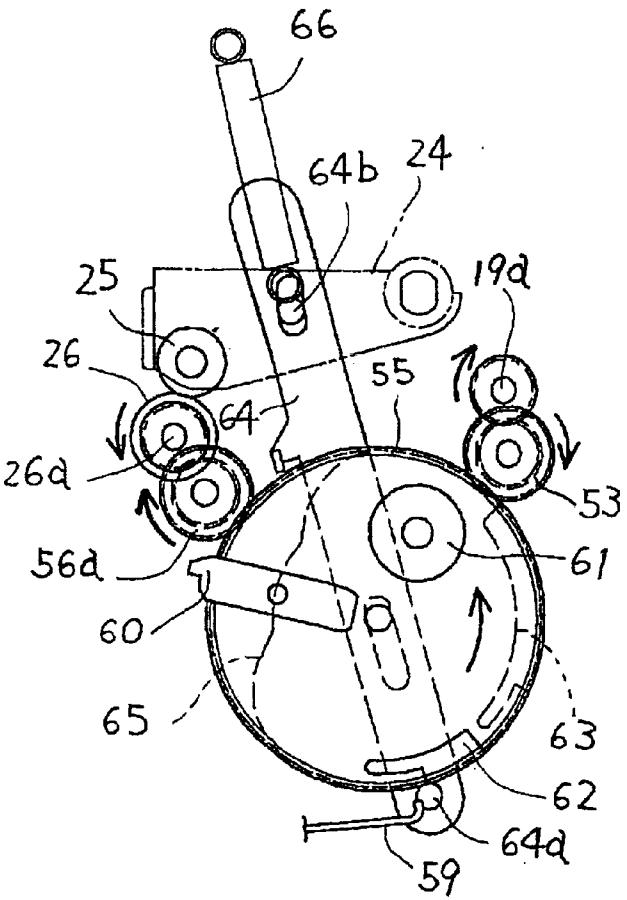

Next, as shown in FIG. 11D, when the distal end 64*a* of the elevating lever 64 elastically contacts the outermost peripheral surface of the cam portion 65 having substantially the same radius as that of the timing driving gear 55, the ejection roller 26 and the driven roller 25 in a distal end side of the rotating unit 24 nip the set of the sheets S after being stapled to eject on the piling tray 5. This completion of ejecting the sheets S is detected such that the sheet presence sensor 30*a* detects the upward returning of the sensor lever 30 located at the distal end of the process tray 29 shown in FIG. 2 and FIG. 3.

When the ejection of the set of the sheets S after being stapled onto the piling tray 5 is completed, as shown in FIG. 11E, the elastic contact between the distal end 64*a* of the elevating lever 64 and the cam portion 65 is released, and the rotating unit 24 starts rotating in the upward returning direction and the driven rollers 25 and the ejection rollers 26 are separated. Thereafter, the notched tooth portions 62 and 63 of the timing driving gear 55 move to positions, wherein the notched tooth portions 62 and 63 respectively resist against the transmission driven roller 53 and the intermediate gear 56*a* for transmitting the driving to the ejection roller 26, to thereby return to the condition shown in FIG. 11A.

Next, the "pass-through mode" will be explained.

This mode is the mode such that the sheet S ejected from the image forming apparatus G is transferred from the first transfer path P1 through the second transfer path P2 and directly stacked onto the piling tray 5, and is suitable for piling the large number of the sheets S without operating the binding process by the staple. Operation of this mode different from that of the "staple mode" resides in that the paddles 23 are not constantly rotated, and the time for starting to rotate the timing driving gear 55 is advanced in accordance with the timing for transferring the sheets.

Namely, when the sheet S is supplied to the inlet 7, the sheet inlet sensor 11 provided between the inlet 7 and the transfer roller 15 detects the sheet. Based on the result detected by the sensor, the driving motor 43 starts driving, and by interlocking with the driving, the transfer roller 15, the second ejection roller 28, and the endless transfer belt driving rollers 19 are rotated through the rotating belt 48. At this time, as shown in FIG. 11A, although the driven transmission gear 53 is also rotated, the notched tooth portion 62 of the timing driving gear 55 faces the driven transmission gear 53, and the lock claw 59 and the engaging piece 60 are engaged with each other, so that the timing driving gear 55 and the ejection roller driving transmission gear 56*a* stop rotating.

After the sheet inlet sensor 11 detects the forward end of the sheet S, in order to allow the timing driving gear 55 to rotate, with a slight delay, as shown in FIG. 11B, the timing solenoid 59*a* is actuated to release the engagement between the lock claw 59 and the engaging piece 60 of the timing driving gear 55, so that the timing driving gear 55 is rotated in the counterclockwise direction by the gravity of the weight 61.

By this rotation, the driven transmission gear 53 is disengaged from the notched tooth portion 62 to engage with the timing driving gear 55, and by receiving the driving from the driven transmission gear 53, the timing driving gear 55 seriously starts rotating. Operations after this rotation are the same as in the operations in the "staple mode" shown in FIG. 11C through FIG. 11E. Therefore, every time the sheet S is transferred into the main apparatus 2, the rotating unit 24 performs the elevating movement and ejects the sheets S onto the piling tray 5. The completion of ejecting the sheets S is detected such that the sheet presence sensor 30*a* detects the upward returning of the sensor lever 30 located at the distal end of the process tray 29 shown in FIG. 2 and FIG. 3.

Incidentally, in order to prevent the rotation of the paddles 23, while the "pass-through mode" is carried out, the solenoid 57*b* is not actuated, and the lock plate 54*c* of the driven gear 54 and the clock claw 57 are in an engaged condition.

Finally, the "escape mode" is a mode such that a special sheet, such as a sheet with an irregular size, is ejected onto the escape tray 6, wherein the rotary type flapper 16 is rotated in the counterclockwise direction from the condition shown in FIG. 2 and FIG. 3, so that the sheet S is transferred from the first transfer path P1 to the fourth transfer path P4, and ejected by the second ejection roller 28 onto the escape tray 6.

In this case, by setting the "escape mode" beforehand, the flapper 16 is rotated and positioned such that the sheet S can be guided to the fourth transfer path P4. In this state, when the sheet S is supplied from the inlet 7, the sheet inlet sensor 11 detects the sheet, and the driving motor 43 starts driving. As a result, as explained in the other modes, the transfer roller 15 and the second ejection roller 28 are driven to rotate to eject the sheet S onto the escape tray 6.

Incidentally, since it is not necessary to rotate the paddle 23 and the timing driving gear 55, the solenoid 57*a* for allowing the rotation of the paddle 23 and the solenoid 59*a* for allowing the rotation of the timing gear 55 are not actuated.

According to the operations described above, the sheets S are ejected from the sheet ejection port 10 of the main apparatus 2, and the piling tray 5 on which the ejected sheets S are stacked is explained in the following.

Figure 12A:
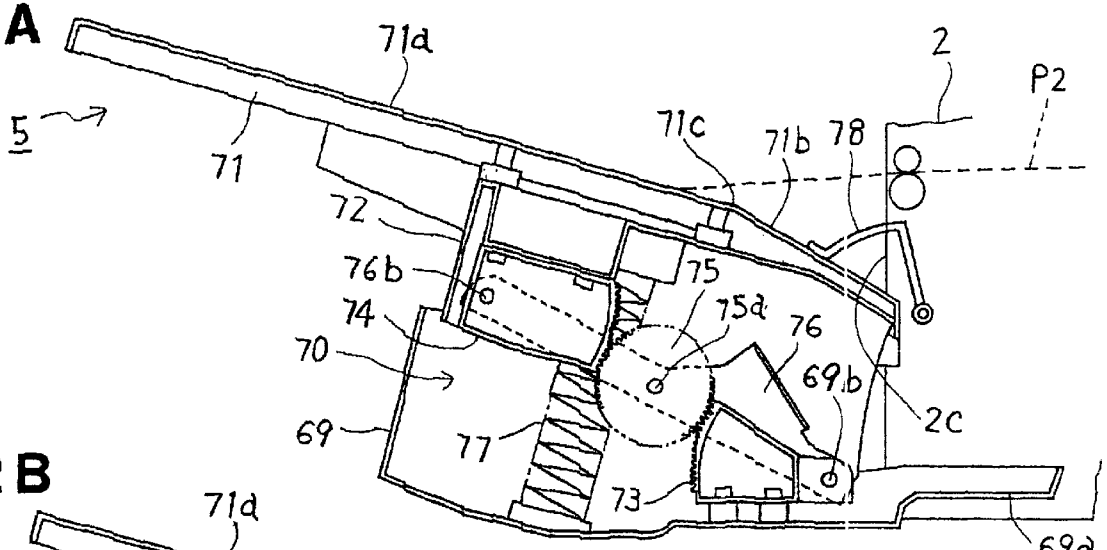
FIGS. 12A and 12B are front sectional views schematically showing a piling tray.
Figure 12B:
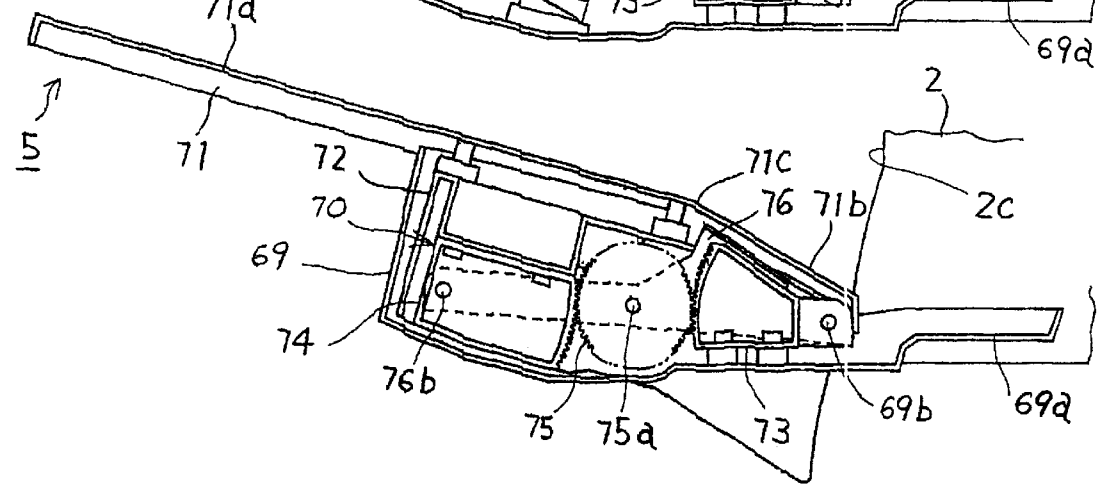

As shown in FIG. 12A and FIG. 12B, in the piling tray 5, there are provided a base 69 having an attachment portion 69*a* detachable to the main apparatus 2; a sheet holding section 71 supported by the base 69 through an elevation control section 70 to be able to ascend and descent; and a support bracket 72 fixed at a lower surface of the sheet holding section 71, wherein the support bracket is fixed at the upper surface portion of a movable gear 74.

The elevation control section 70 includes a fixed gear 73 in an arc shape fixed to the base 69; the movable gear 74 in an arc shape fixed to the support bracket 72; a planetary gear 75 moving by engaging with respective gears 73 and 74; a shift arm 76 connecting the respective gears 73 and 74 with the planetary gear 75 to fix the relative distance therebetween; and a coil spring 77 which is disposed between an upper surface of the base 69 and a bottom surface of the support bracket 72 to always urge the sheet holding section 71 upwardly.

Two pieces of the coil springs 77 are disposed by interposing the respective gears 73, 74 and the planetary gear 75, and have a spring constant to move the sheet holding section 71 downwardly in accordance with weight of the sheets S sequentially stacked on an upper surface of the sheet holding section 71, so that the subsequent sheet S can be sequentially placed, at the substantially same height, on an upper surface of the preceding sheet S.

Also, when the sheet holding section 71 as a surface for supporting the sheets is displaced downwardly by resisting against the urging by the coil spring 77, in accordance with the change in the engaging positions between the respective gears 73 and 74 and the planetary gear 75, the upper surface of the sheet holding section 71 attached on the upper surface of the movable gear 74 through the support bracket 72 is lowered from the upper position in FIG. 12A in case the amount of the stacked sheets S is increased, to thereby move to the lower limit position in FIG. 12B in a substantially parallel condition. Therefore, in the condition that an angle formed by the upper surface of the sheet holding section 71 and the sheet regulating surface 2*c*, which is provided in front of the main apparatus 2 and regulates the end rims of the stacked sheets, does not change significantly to have a substantially constant condition all the time, the sheet holding section 71 is lowered in accordance with the increase in the amount of the stacked sheets, so that the difference in the height between the upper surface of the stacked sheet and the ejection roller 26 can be maintained in approximately the constant distance.

Also, in order to have the piling sheets slide down by their own weights, the upper surface of the sheet holding section 71 is inclined to be gradually higher from the position of the sheet regulating surface 2*c* of the main apparatus 2 toward the upstream side of the sheet ejecting direction, and the inclination angle in the vicinity of the sheet regulating surface 2*c* is set different from the inclination angle at the upstream side of the ejecting direction upper than that in the vicinity of the sheet regulating surface 2*c*.

Namely, the upper surface support section of the sheet holding section 71 is formed of a first support surface 71*a* wherein an angle formed by a sheet ejection direction extension line SP, which is defined by the ejection roller 26 and the ejection driven roller or the like, and the upper surface of the sheet holding section 71 is a relatively small angle α; and a second support surface 71*b* at the sheet regulating surface side wherein an angle β greater than the angle α is set. Then, a bending portion 71*c* (a portion of changing the angle from the first support surface 71*a* to the second support surface 71*b*), wherein the above angle α is changed to the angle β, is set at the position closer to a side of the sheet regulating surface 2*c* than the position in which the sheet ejection direction extension line SP intersects the upper support surface of the sheet holding section 71.

Therefore, since a large difference in height can be set between the side of the sheet regulating surface 2*c* and the ejection roller 26, even if the rear end (the end rim in the side of the sheet regulating surface 2*c* of the sheet S stacked on the sheet holding section is curled upwardly in the drawing, the forward end of the sheet ejected subsequently hardly abuts against the rear end portions of the sheets which have been stacked already. Also, it can be avoided that the forward end of the sheet to be ejected is curled downwardly and wound in.

Incidentally, according to the experiment, in case a copy sheet generally used for this type of the apparatus is used, it has been clarified that the angle α formed between the sheet ejection direction extension line SP and the upper surface of the sheet holding section 71 is desirably in a range from 15 degrees to 23 degrees, and the angle β is 25 degrees or more which is larger than the angle α. However, since these angles are changed according to the thickness and material of the sheet to be used, they are not limited to the above numeral values of the angles, and it is only required that the angle β is set larger than the angle α.

Also, although the example in the drawing is the second support surface 71*b* inclined by continuously connecting to the first support surface 71*a* through the bending portion 71*c*, the first support surface 71*a* and the second support surface 71*b* can be connected with a step portion therebetween, or the bending portion 71*c* can be an arc surface in which the angle is gradually changed. Most importantly, it is structured such that the difference in height between the ejection port 10 and the second support surface 71*b* is larger than that in case of merely extending the upper surface of the first support surface 71*a* toward the side of the sheet regulating surface 2*c*.

Further, in the apparatus of the embodiment, there is an occasion that the sheet is extended over the process tray 29 and the sheet holding section 71 to be placed. In this case, even if the placed sheet is the smallest size sheet, it is set such that the forward end of the sheet in the sheet holding section side is located at the upper stream side of the ejection direction than the bending portion 71*c*, to thereby solve the disadvantages due to the upward curl or downward curl.

Also, as shown in FIG. 1, the staple unit side end portion of the second support surface 71*b* is provided with a notched portion 71*d*. The notched portion 71*d* is a notch provided for preventing the staple portions from bulging largely upwardly even when the sets of the sheets in which staples are driven are stacked and piled.

Further, as explained in FIG. 2 and FIG. 3, the sheet pressing lever 78 for holding down the rear end (the end rim in the side of the sheet regulating surface 2*c*) of the sheet S from an upper side of the second support surface 71*b* of the sheet holding section 71 is projected from or retracted into the side of the sheet regulating surface 2*c*, and even in case the sheet is largely curled on the second support surface, the sheets S can be securely piled on the sheet holding section 71.

The sheet pressing lever 78 is rotated around a rotational shaft 82 as a supporting point, and in the condition that the sheet pressing lever 78 presses the sheet, the end portion of the lever is detected by a sheet stack amount detecting sensor 85. In case the sensor 85 detects the end portion of the pressing lever 78, it is considered that the sheet is located at the lower limit position of the sheet holding section 71, to thereby output a process stop signal to the image forming apparatus main body G.

Here, the operation of stacking the sheets S ejected from the main apparatus 2 will be explained by using FIGS. 13A to 13D.

Figure 13A:
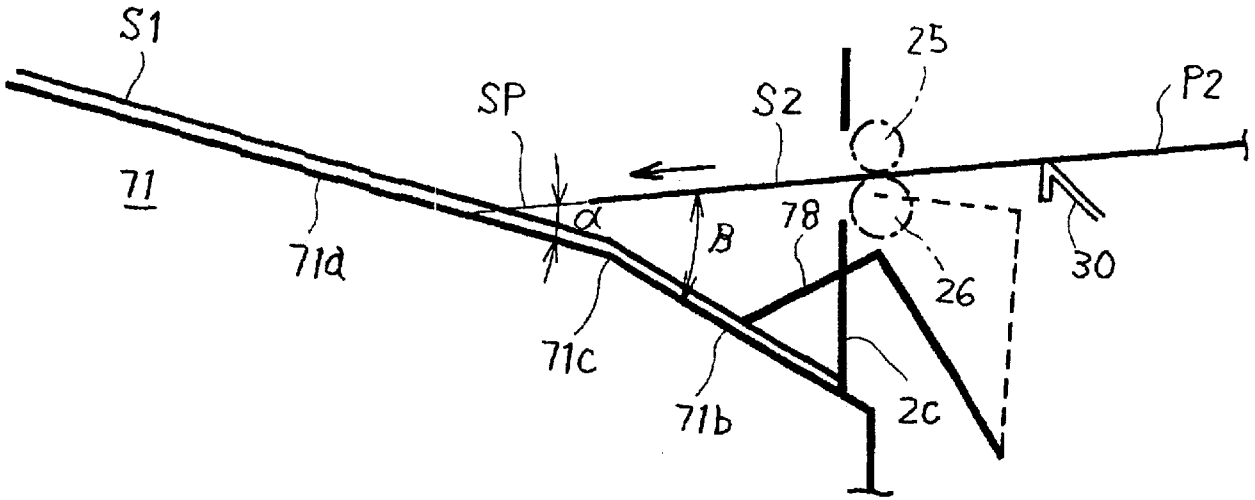
FIGS. 13A through 13D are explanatory operation condition views schematically showing stacking conditions of sheets stacked on the piling tray.

Firstly, in the condition shown in FIG. 13A, the sheet S1 ejected first is placed on the sheet holding section 71, and the end rim of the sheet S1 is pressed on the second sheet support surface 71*b* by the sheet pressing lever 78. Then, the subsequent ejected sheet S2 is transferred along the second transfer path P2, and is about to be ejected by the ejection roller 26 in the ejection path. The sheet S2 is ejected on the sheet ejection direction extension line SP, and the sheet ejection direction extension line SP intersects the first sheet support surface of the sheet holding section 71, wherein the intersecting angle is set at a relatively small angle α. Therefore, even if the forward end of the sheet S2 is curled downwardly, since the angle is small, the forward end of the sheet S2 is not bent and transferred toward the second sheet support surface side, and is guided toward the downstream side of the ejection direction along the first support surface 71*a*.

Also, since the rear end of the sheet SI precedently stacked is pressed against the second support surface 71*b* by means of the sheet pressing lever 78, the sheet S1 is not moved by the sheet S2.

Figure 13B:
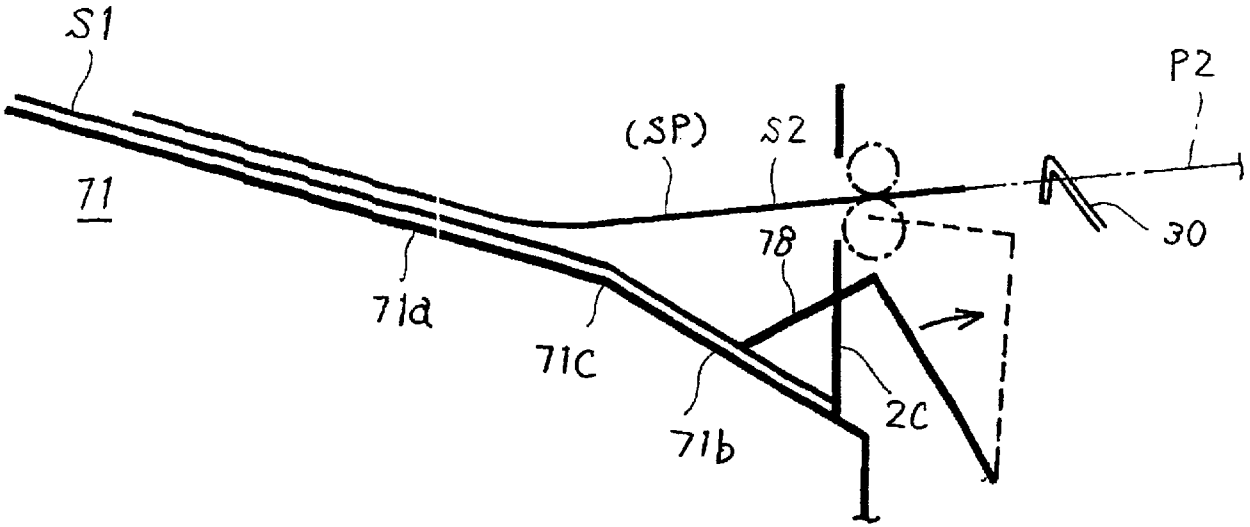

FIG. 13B shows a condition in which the rear end of the sheet S2 passes through the sensor lever 30, and after a predetermined little time has passed since the signal of passing, the rear end of the sheet S2 is ejected from the ejection roller 26 to start falling toward the second support surface 71*b*. At almost the same time as this ejection, the pressing lever solenoid 83 shown in FIG. 2 is actuated, so that the sheet pressing lever 78 is retreated inside the sheet regulating surface 2*c* as shown by the arrow in FIG. 13B.

Figure 13C:
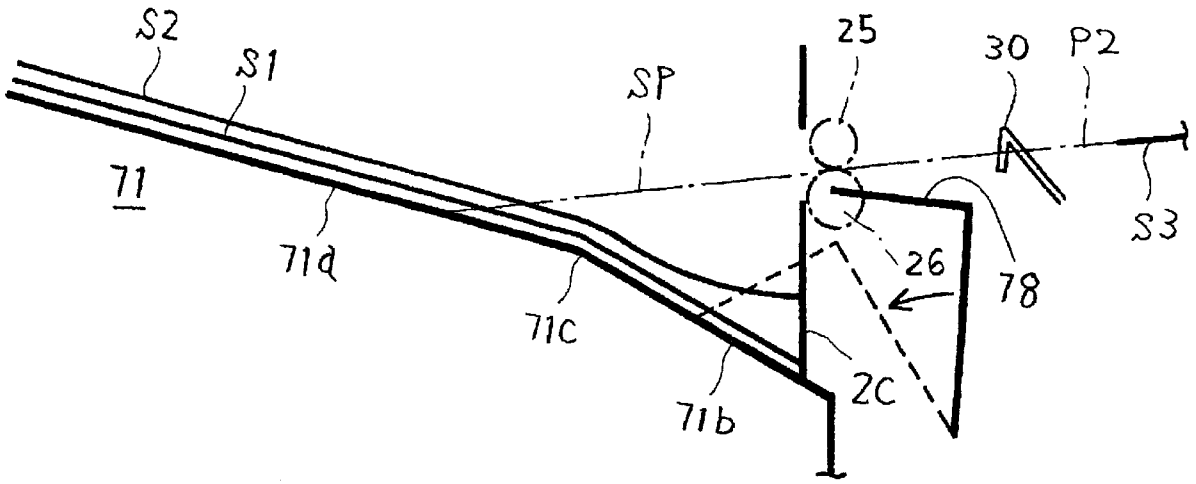
Figure 13D:
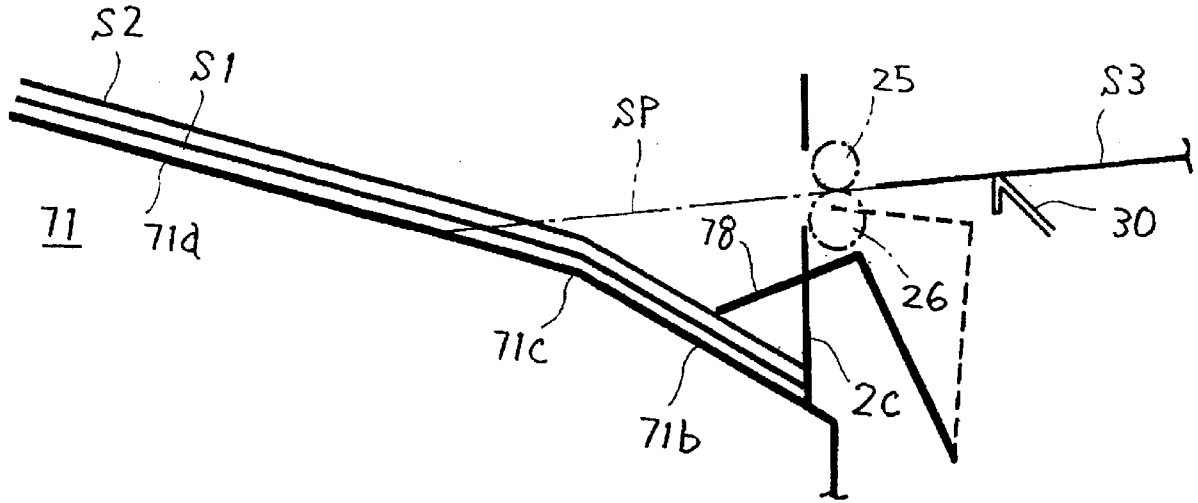

After the retreating, the sheet S2 starts falling toward the second support surface 71*b* as shown in FIG. 13C, and with the time lag of the falling time, the lever solenoid 83 releases the actuation. By this release, the sheet pressing lever 78 is moved toward the second support surface side in the arrow direction in the figure by means of a return spring 84 to become the condition in FIG. 13D, so that the sheet pressing lever 78 presses the rear end of the sheet S2 (the end rim in the side of the sheet regulating surface 2*c*).

As described above, since the angle β formed by the sheet ejection direction extension line and the second support surface in the side of the sheet regulating surface 2*c* is set larger than the angle α formed by the extension line of the direction of ejecting the sheet S and the first support surface, the height difference between the ejection roller 26 and the second support surface can be set large. Also, by pressing from the upper side of the second support surface, there is no jam of the piled sheets, so that the piling performance can be improved.

Also, in case of ejecting the sets of the sheets S, since the same operation as in the single sheet feeding is carried out, the ability of stacking the sets of the sheets can be improved also in this case. Further, in the piling tray 5, when the amount of piling the sheets S is increased, the coil spring 77 is compressed, so that the uppermost surface of the sheets is maintained at the substantially constant height.

Further, although the sheet is shifted by the aligning plate toward the sheet width direction under the condition that the sheet is extended over the piling tray 5 and the process tray 29, since the sheet in the piling tray 5 is pressed by the sheet pressing lever 78, the aligning condition of the piled sheets is not disturbed.

Figure 14:
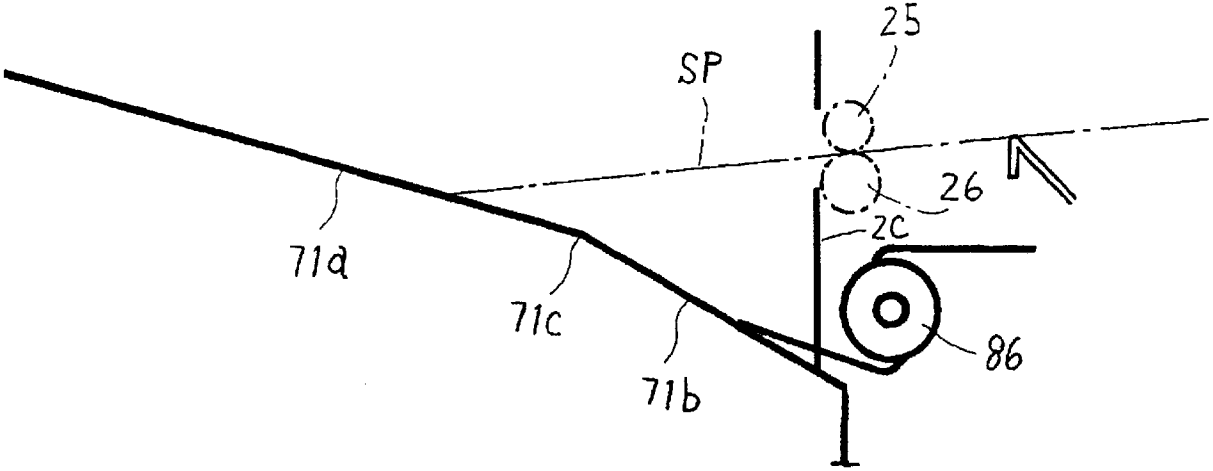
FIG. 14 is a conceptual view schematically showing another embodiment of a pressing lever for pressing a sheet on the piling tray in FIG. 2.
Figure 15:
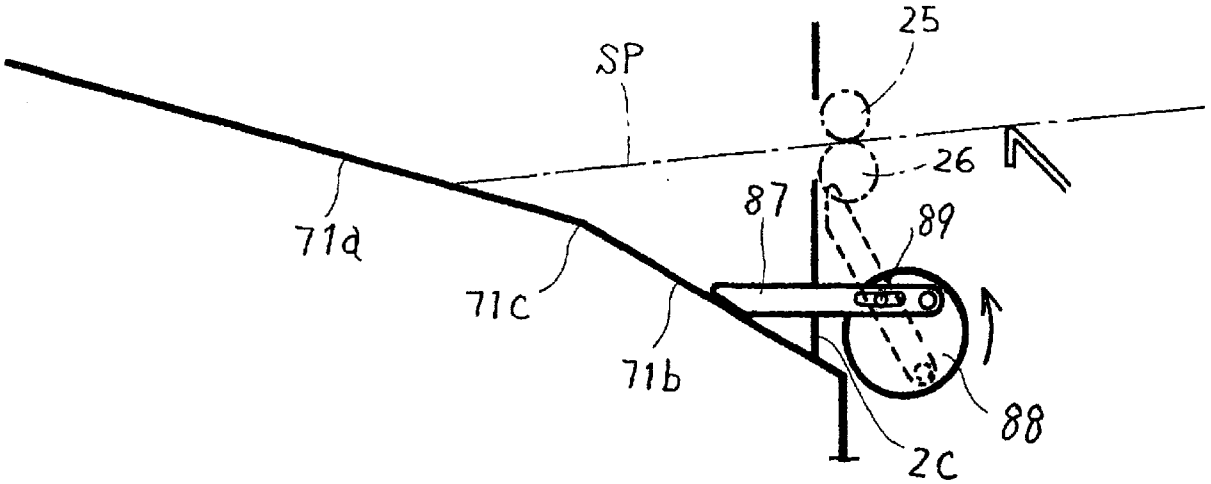
FIG. 15 is a conceptual view schematically showing still another embodiment of the pressing lever for pressing a sheet on the piling tray in FIG. 2.

Incidentally, in the explanation of the embodiment heretofore, as the means for pressing the sheet, the sheet pressing levers 78 moved by the solenoid are provided. However, as shown in FIG. 14, a pressing paddle roller 86 provided with the elastic pieces made of the rubber or the like may be rotated adequately by a motor, not shown, in accordance with the sheet ejecting timing so that the paddle is projected from and retracted into the sheet regulating surface 2*c*. Also, as shown in FIG. 15, it can be structured that a base end portion of a sheet pressing lever 87 is attached to a cam plate 88 rotated by the motor, not shown, and a fixed pin 89 fitted in a slit in the lever 87 performs a link motion to thereby press the sheet.

Namely, any means will suffice as long as the means is retreated only when the sheet S is ejected from the ejection roller 26 and falls, and the means presses the end portion of the sheet at the other time.

The aforementioned explanations and FIGS. 1 through 15 are the explanations for the embodiment of the first type. Next, an embodiment of a second type will be explained by using FIGS. 16 through 22. The same parts as in the first type are represented by the same reference numbers in the figures, so that the explanations therefor are omitted.

Figure 16:
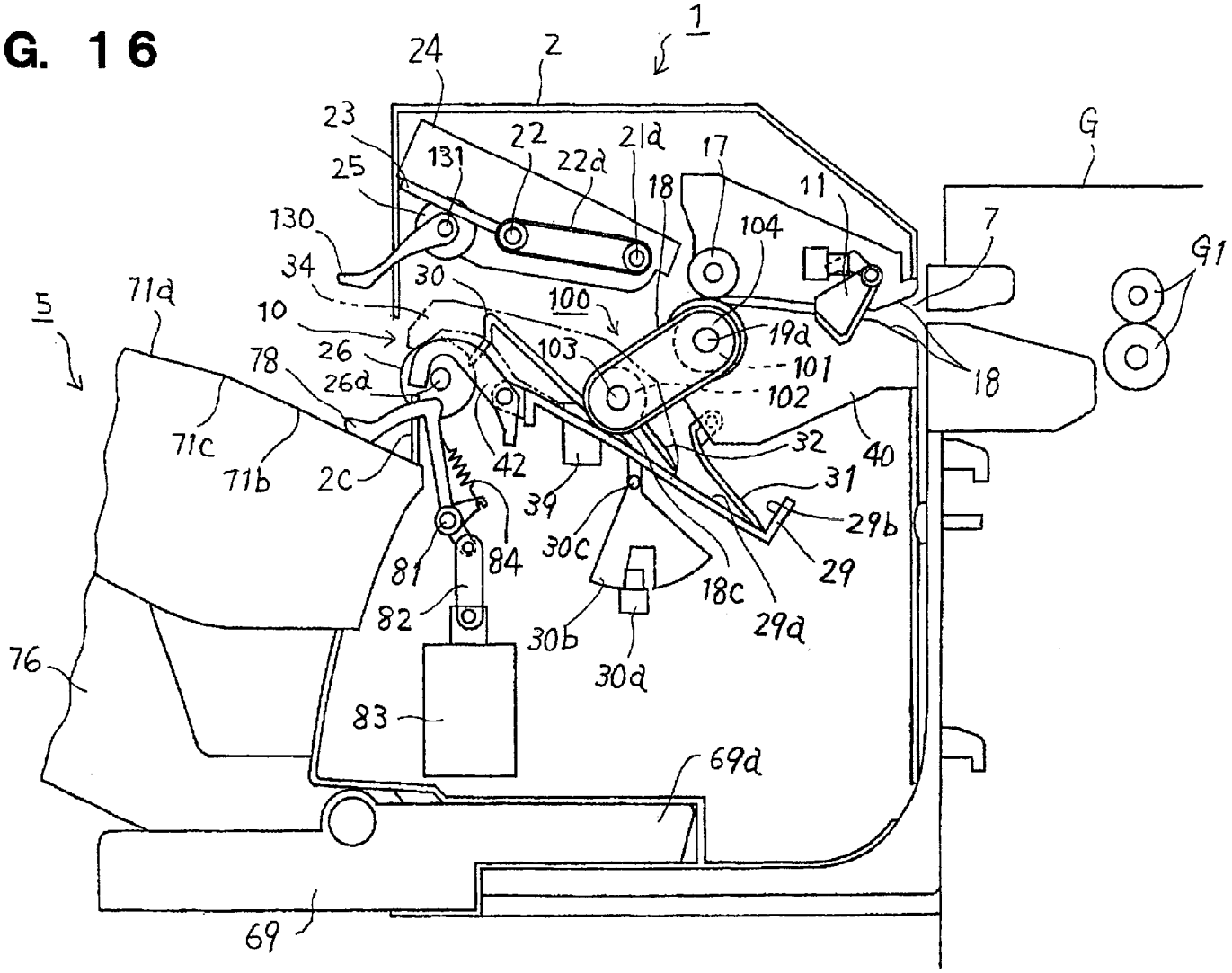
FIG. 16 is a front sectional view schematically showing an inner mechanism of a sheet receiving apparatus of a second type as another embodiment of the invention.

The difference in the apparatus of the first type from the apparatus of the second type is schematically explained by FIG. 16.

Firstly, the escape tray 6, which is located above the piling tray 5 and holds the special sheet or the like, and the fourth transfer path P4 leading thereto are omitted. Therefore, the special sheet or the like is ejected in the image forming apparatus side in advance to thereby miniaturize the finishing apparatus 1 as the sheet piling apparatus.

Secondly, in the apparatus of the first type, the sheet placing section side (18*c*) of the endless transfer belt 18 for transferring the sheet S along the third transfer path P3 into the process tray 29 is free. However, in the apparatus of the second type, the sheet placing section side (18*c*) is also supported by the driven pulley.

Thirdly, although driving for ascending and descending the sheet holding section 71 of the piling tray 5 is operated by the coil spring 77, the driving for ascending and descending is operated by the motor. At the same time, the uppermost surface of the sheets stacked on the sheet holding section 71 is detected, and by this signal, the elevating and lowering the sheet holding section 71 are operated. Also, an own weight flapper or sheet flapper 130 is provided coaxially with the ejection driven roller 25 of the rotating unit 24 such that the sheet ejected from the ejection roller 26 quickly falls onto the sheet holding section.

Next, the above features are individually explained.

Figure 17:
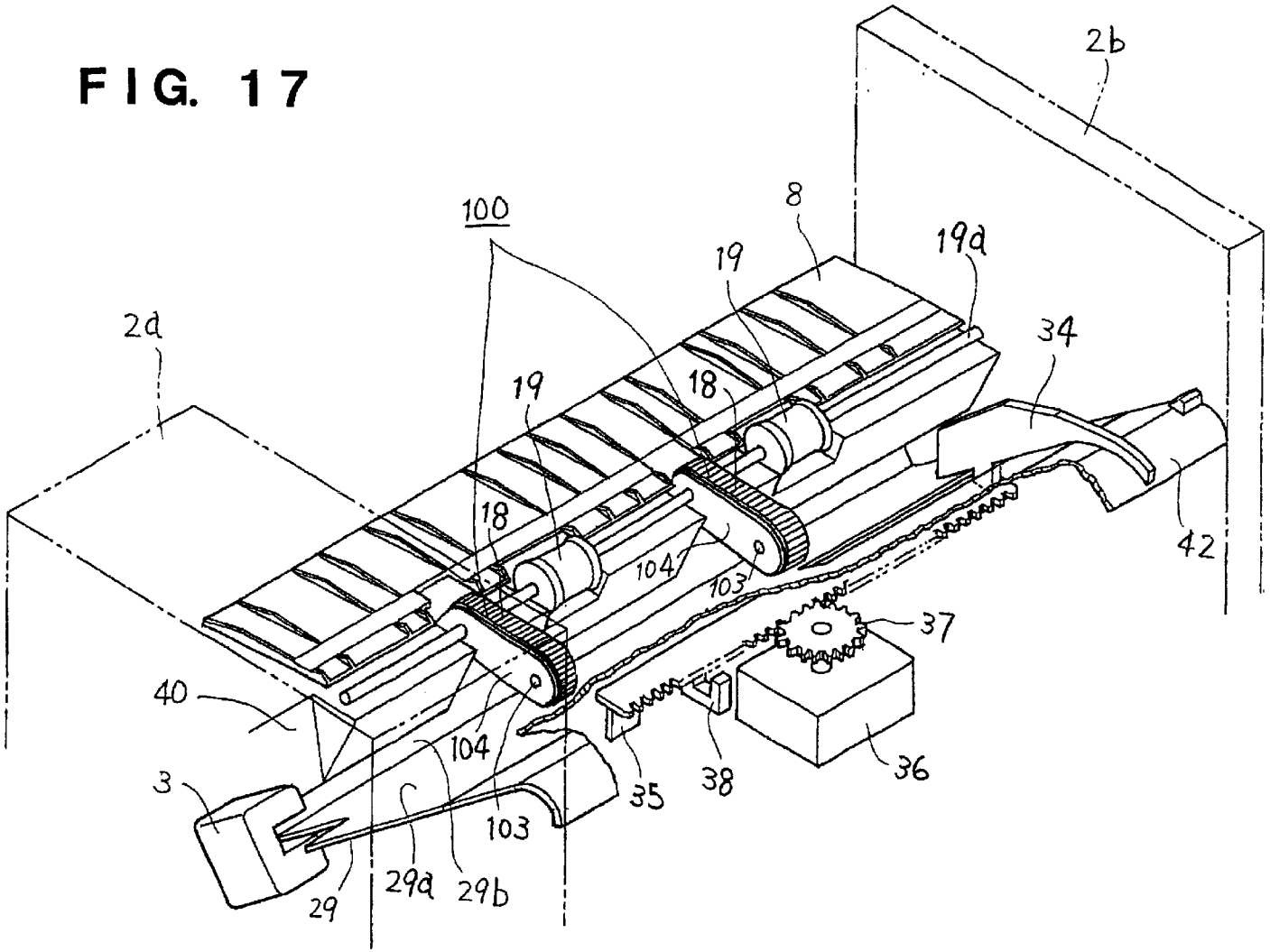
FIG. 17 is a perspective view schematically showing an inner mechanism of a temporary placing tray, wherein a part of the apparatus shown in FIG. 12 is omitted.

The apparatus of the second type shown in FIG. 16 and FIG. 17 includes feeding belt units 100, on which the endless transfer belts 18 are extended, as the sheet transferring means for transferring the sheet S along the third transfer path P3 into the process tray 29. Explaining each feeding belt unit 100 by also including FIG. 18, the feeding belt unit 100 is formed of a driving pulley 101 attached to the belt driving shaft 19*a* and rotating together with the driving shaft; a driven support pulley 102 spaced away from the driving pulley 101 with a predetermined space therefrom and located in the side of the sheet placing surface 29*a*; support plates 104 keeping the interval between driving pulley 101 and the driven support pulley 102 and provided at both sides of the each pulley; and the endless transfer belt 18 extended between the driving pulley 101 and the driven support pulley 102. A rotational shaft 103 of the driven support pulley 102 is freely rotatably supported by the support plate 104.

Therefore, when the belt driving shaft 19*a* is driven to rotate, the driving pulley 101 fixed on the shaft 19*a* also rotates, so that the endless transfer belt 18 is moved while rotating the driven pulley 102.

Figure 18:
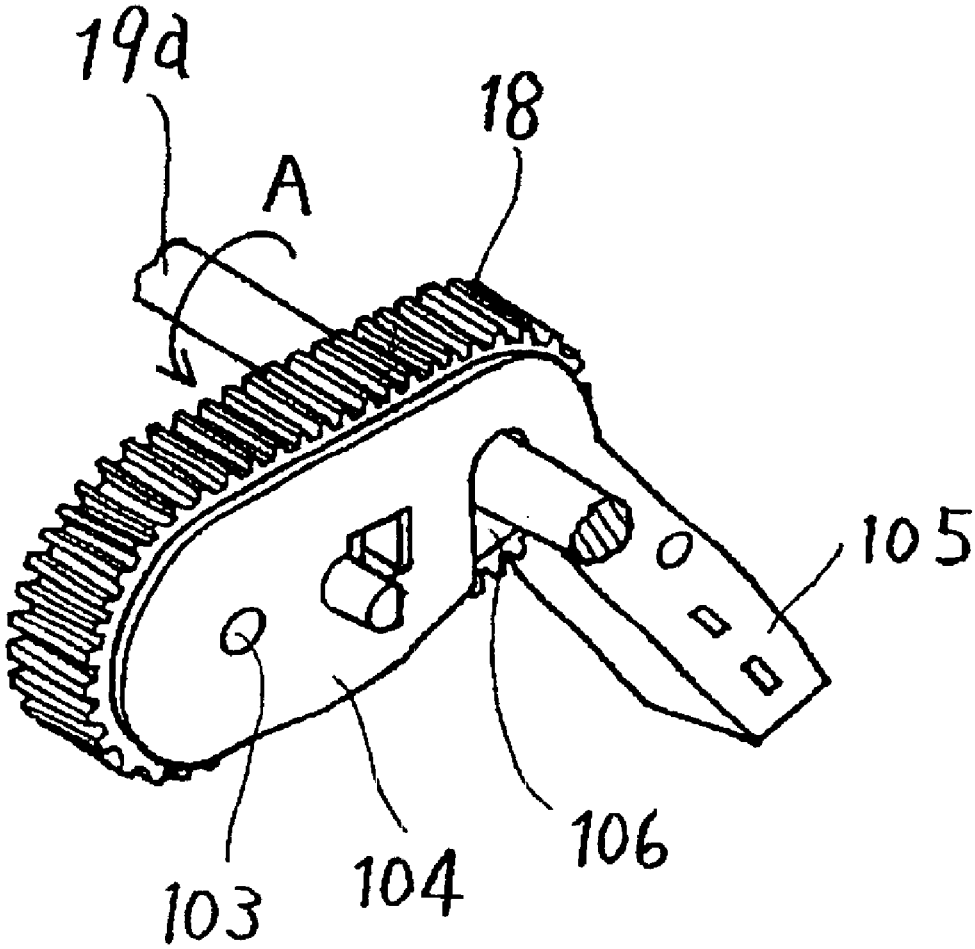
FIG. 18 is a perspective view schematically showing a feeding belt unit section of FIG. 16.

Also, the support plate 104 includes an attachment portion 106 in a reverse U shape. Since the attachment portion 106 is not fixed to the belt driving shaft 19*a*, the support plate 104 including the driven support pulley 102 is capable of freely swinging on the belt driving shaft 19*a* as the supporting point. Further, as shown in FIG. 18, in the support plate 104, a weight balance portion 105 is provided on a side opposite to the driven support pulley 102. The weight balance portion is provided for allowing the sheet feed-in section 18*c* of the endless transfer belt 18 in the side of the driven support roller 102 to contact the sheet S with an approximately predetermined contacting force.

When the feeding unit 100 structured as described above is adopted, in case the number of the sheets stacked on the process tray 29 is increased, the sheet feed-in section 18*c* of the endless transfer belt 18 as a portion of contacting the uppermost sheet is lifted by the thickness of the sheets S. In other words, the support plate 104 is swung around the belt driving shaft 19*a* as a center. The swinging direction is a direction opposite to the rotation direction A of the belt driving shaft 19*a*.

Since the aforementioned endless transfer belt 18 is backed up by the driven support pulley 102, in accordance with the number of the sheets on the sheet placing section 29*a* of the process tray 29, the endless transfer belt 18 is swung. However, even if the number of the sheets placed on the process tray 29 is increased, the area of the endless belt 18 contacting the sheet S does not change. Namely, there is no incidence that the transferring force changes or is too strong by the number of the stacked sheets S. Thus, even if the number of the sheets placed on the sheet placing section 29*a* is increased, there is no incidence that the sheet S abutting against the sheet forward end regulating piece 29*b* is further pushed to bend the sheet S.

Also, the sheet feed-in section 18*c* of the endless transfer belt 18 is located at a position overlapping the aligning plate 34 as in the endless transfer belt 18 of the first type, and further backed up by the driven support pulley 102, so that the sheet S can be precisely aligned even if the sheet S is moved by the aligning plate 34 in the width direction.

Incidentally, the feeding belt unit 100 is provided with the weight balance 105, and by adjusting the rotation moment by the weight balance 105, the pressing force against the sheet S by the endless transfer belt 18 can be adjusted.

However, in case the weight of the support plate 104 side is light, there is a case that the weight balance 105 is not required. Also, instead of the weight balance 105, the pressing force can be adjusted by a spring member or the like.

Figure 19:
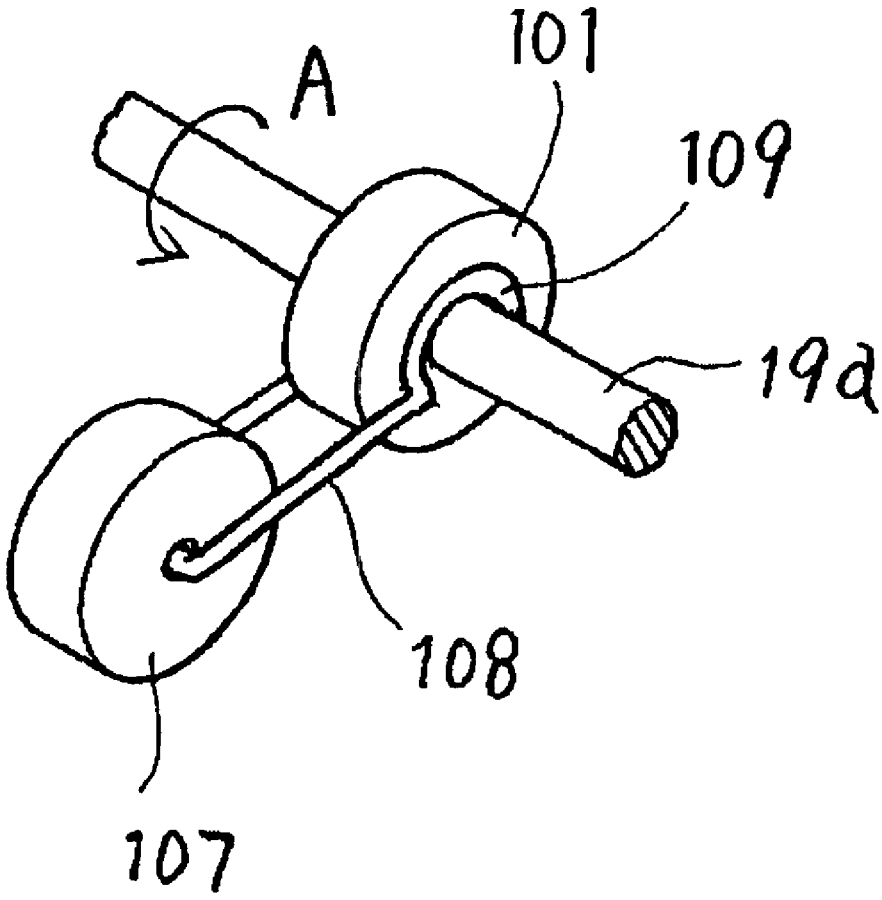
FIG. 19 is a perspective view schematically showing another embodiment of the feeding belt unit section of FIG. 18.

Further, as shown in FIG. 19, the structure of the support plate 104 of the feeding belt unit 100 is simplified, and it can be structured such that the driven support pulley 107 is freely rotatably supported at by the wire-shaped support arms 108 and a swinging end in a reverse U shape in a side opposite to the driven support pulley 107 is suspended from the belt driving roller shaft 19*a*.

Figure 20:
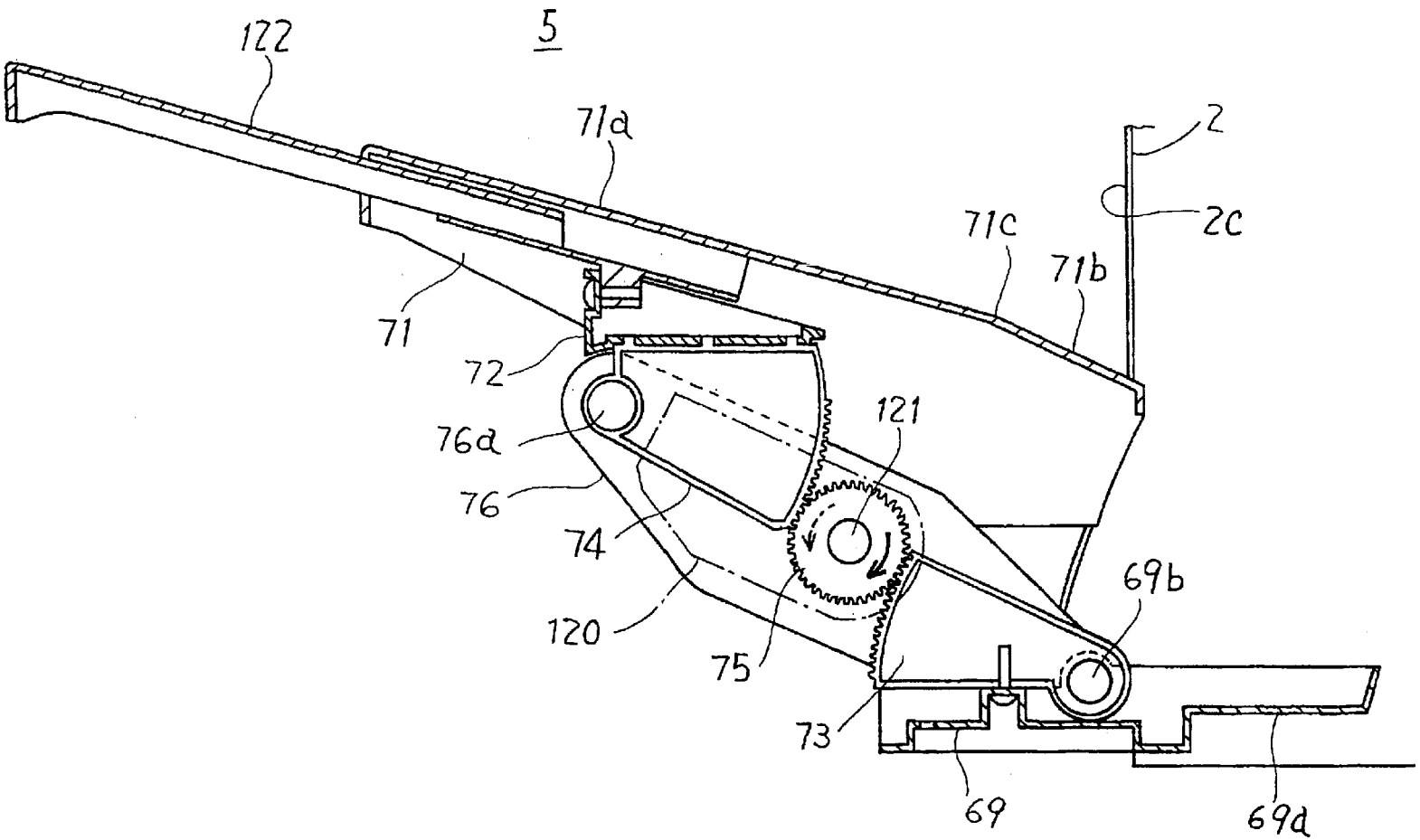
FIG. 20 is a front sectional view schematically showing a piling tray attached to FIG. 16.

Next, the piling tray 5 of the second type is explained by using FIG. 20.

In the piling tray 5, an elevating mechanism of the sheet holding section 71 uses the motor unit 120 which includes the motor therein. The motor unit 120 is attached to the shift arm 76 which supports the movable gear 74 and the planetary gear 75, and the motor shaft 121 from the motor unit 120 is connected to the planetary gear 75. The sheet holding section 71 is elevated when the motor rotates the motor shaft 121 in the clockwise direction, and the sheet holding section 71 is lowered when the motor rotates the motor shaft 121 in the counterclockwise direction. Therefore, the uppermost position of the sheets stacked on the sheet holding section 71 is detected, and the detected signal is sent to the motor unit 120 to control the forward and reverse rotations of the motor, so that the sheet level can be more precisely maintained constant.

Figure 21:
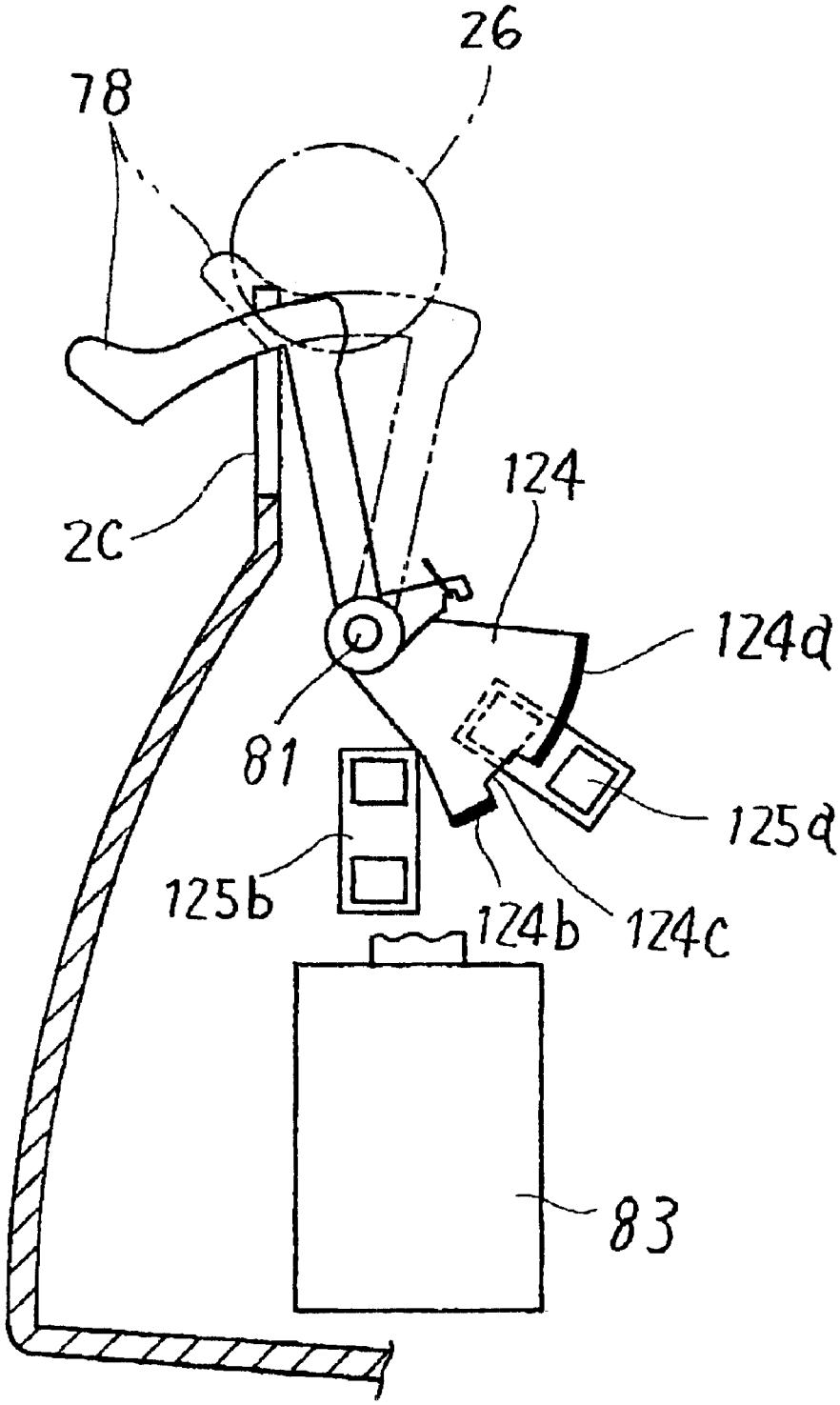
FIG. 21 is a partly sectional view schematically showing a mechanism for detecting a portion of a pressing lever for pressing a sheet against the piling tray of the apparatus in FIG. 16.

Here, as shown in FIG. 21, the mechanism for detecting the sheet level is operated by detecting a detection flag 124, which is integrally formed with the sheet pressing lever 78 rotating around the supporting point 81, by transmission type sensors 125*a* and 125*b*. As shown in the drawings, the detection flag 124 includes a first flag section 124*a* and a second flag section 124*b*, and a notch section 124*c* which does not respond to the sensor is provided between the flags.

The condition in FIG. 21 shows the position in which the sheet pressing lever properly presses the sheet S, and at this time, the first sensor 125*a* is blocked by the first flag section 124*a* to be "ON". On the other hand, the second sensor 125*b* is not detected by the second flag 124*b* to be an "OFF" condition. The condition is the position in which the sheet holding section 71 of the piling tray 5 is set properly. From this condition, the sheets S are sequentially ejected onto the sheet holding section 71, and at every ejection, the sheet pressing lever 78 is also reciprocated between a position shown by the two-dotted chain lines and a position shown by the solid lines in the figure. Every time the sheet S is placed on the sheet holding section, the detection flag 124 is moved in the clockwise direction, so that the second flag section 124*b* is detected by the second sensor 125*b* to become "ON", and the first flag section 124*a* is detected by the first sensor 125*a* to become "ON" condition. When both the first sensor 125*a* and the second sensor 125*b* become "ON" as described above, the signal for lowering the sheet holding section 71 is issued to the piling tray 5. By this signal, the motor unit 120 rotates the motor driving shaft 121 in the counterclockwise direction to lower the sheet holding section 71 for a predetermined amount.

As described above, the uppermost surface of the sheets stacked on the sheet holding section 71 is always positioned in a predetermined range of the height.

In passing, the sheet holding section 71 usually does not move vertically every time the sheet is ejected, and the sheet holding section is lowered when the uppermost surface of the stacked sheets becomes more than a predetermined height. Thus, there is solved the cumbersome problem that the sheet holding section is moved at every sheet ejection.

Incidentally, when the notch section 124*c* is located at the first sensor 125*a* such that the first sensor 125*a* is "OFF" and the second sensor 125*b* is "OFF", it is considered that the sheet holding section 71 is located at the position lower than the predetermined height, so that the sheet holding section 71 is elevated. When the first sensor 124*a* is "OFF" and the second sensor is "ON", it is determined that the sheet pressing lever 78 is in a condition of retreating toward the side of the sheet regulating surface 2*c*. Also, when the sheet holding section 71 is located at the lower limit position such that both the first sensor 124*a* and the second sensor 124*b* are "ON", it is determined that the sheets on the sheet holding section 71 is full, so that the operation for stacking the sheets is stopped.

The foregoing is the structure for detecting the sheet level in the piling tray 5, and in order to stack the sheets on the piling tray securely, as shown in FIG. 16, the apparatus of the second type is provided with a sheet flapper 130 freely rotatable on the support shaft 131 of the driven ejection roller 25 supported by the rotating unit 24. The sheet flapper 130 moves up and down in accordance with ejecting the sheet, and is provided for allowing the rear end of the sheet S to definitely fall on the sheet holding section.

Figure 22A:
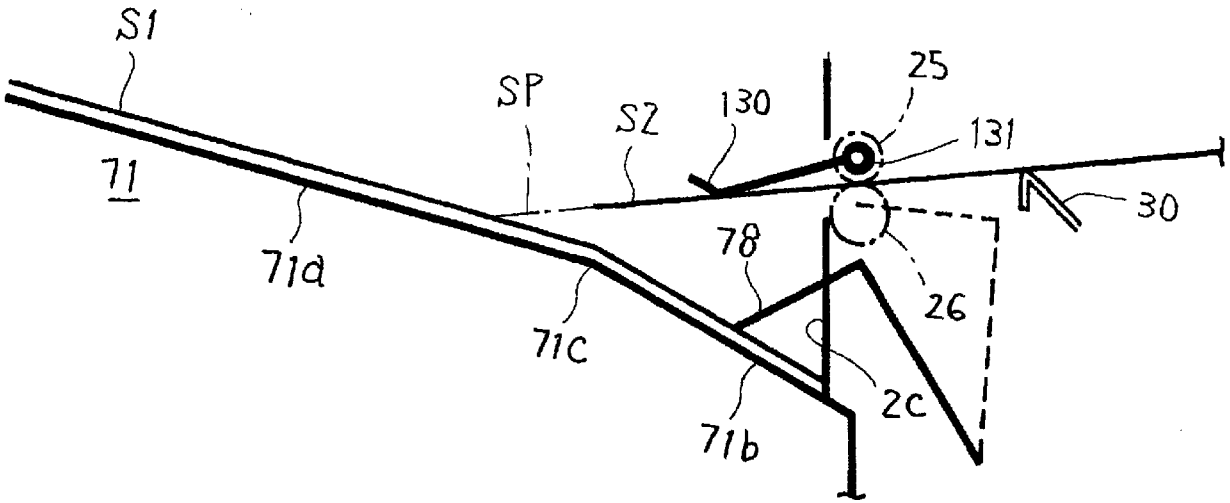
FIGS. 22A and 22B are operation condition explanatory views schematically showing piling conditions of sheets stacked on the piling tray.
Figure 22B:
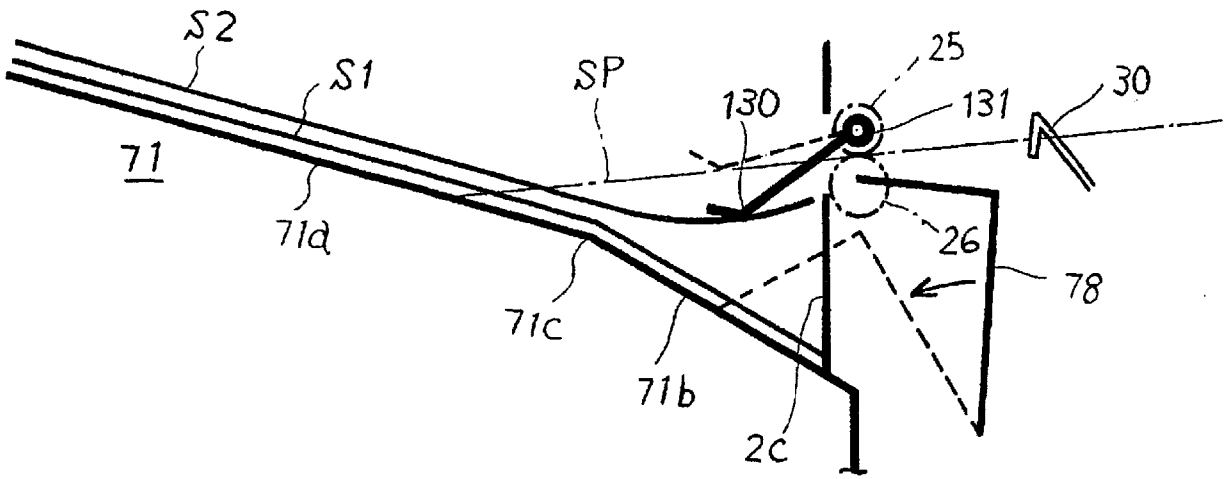

The operation of the sheet flapper 130 is explained by FIGS. 22A and 22B. Incidentally, since functions and operations that the sheet pressing levers 78 press the sheet on the sheet holding section 71 are the same as those explained in FIGS. 13A to 13D, the sheet flappers 130, which allow the ejected sheet S to fall onto the sheet holding section 71 in cooperation with the sheet pressing levers 78, is mainly explained hereinafter.

FIG. 22A shows a condition that the rotating unit 24 is located at the lowered position and the sheet S2 is ejected on the sheet ejection direction extension line SP by means of the ejection roller 26 and the ejection driven roller 25. In this condition, since the sheet flapper 130 is simply suspended at the support shaft 131 of the ejection driven roller 25, the sheet is supported through the nip by the ejection roller 26 and the ejection driven roller 25, so that the sheet pushes up the sheet flapper 130 to be ejected. This condition continues until the rear end of the sheet S2 is released from the sheet nip by the ejection roller 26 and the ejection driven roller 25.

When the rear end of the sheet S2 is released from the sheet nip by the ejection roller 26 and the ejection driven roller 25, as shown in FIG. 22B, the rear end of the sheet S is pushed down by the own weight of the sheet flapper 130 to fall along the sheet regulating surface 2*c*. At the same time as this falling, the sheet pressing lever 78 is rotated in the clockwise direction to press the rear end of the sheet S2 onto the sheet holding section 71. Therefore, even if the rear end of the sheet S is largely curled toward the upper side of the ejection roller side, the curl is corrected through the downward rotation by the own weight of the sheet flapper 130, to thereby solve the disadvantage such that the rear end of the sheet collides with the forward end of the sheet S subsequently ejected to cause the jam.

Incidentally, regarding the positional relation in the sheet width direction (the direction crossing the sheet transferring direction) between the sheet pressing lever 78 and the sheet flapper 130, in case the sheet pressing levers 78 are disposed at three points (refer to FIG. 1), plural pieces (two pieces in the embodiment) of the sheet flappers are disposed between these sheet pressing levers 78, so as to prevent the collision between the sheet pressing levers 78 and the sheet flappers 130. In passing, although the sheet flapper 130 of the embodiment is rotated by the own weight to press the rear end of the sheet S, the movement of the sheet flapper 130 can be driven to rotate up and down by the driving means, such as a solenoid, in accordance with the timing of ejecting the sheet S.

As described above, according to the present invention, in case the ejected sheets are stacked, unnecessary abutment between the stacked sheets and the sheet subsequently ejected can be prevented, and it can be also prevented to stack and place the curled sheet as it is.

Also, there are the following excellent effects. In case the sheet is temporarily placed in order to apply a predetermined process to the sheet before the sheet is ejected outside the apparatus, the jam caused by the placed sheet and the subsequent sheet is prevented, so that the sheet placing performance which surely allows the expected number of the sheets to be temporarily placed can be secured. Also, the sheets are aligned precisely to be stacked or placed, and at the same time, the apparatus as a whole can be made small and lightweight.

While the invention has been explained with reference to the embodiments of the invention relatively in detail, the explanation for the preferred embodiments are changed regarding the details of the structure, so that it is not prevented to variously modify the combination and arrangement of the structural elements by not going against the spirits and the following claims.

What is claimed is:

1. A sheet receiving apparatus, comprising:

ejecting means for ejecting a sheet, a sheet placing surface inclined such that the sheet is placed toward an upstream side of an ejecting direction of the ejecting means, said sheet placing surface being formed of a first sheet placing surface for placing the sheet with a first angle formed by the sheet ejecting direction and the sheet placing surface; an angle change section for changing an angle of the sheet placing surface at an upper stream side of the ejecting direction relative to a position where the first sheet placing surface intersects with the sheet ejecting direction; and a second sheet placing surface having an angle greater than the first angle and placing an upstream side portion of the sheet in the ejecting direction, sheet pressing means for pressing the sheet toward the second sheet placing surface, driving means connected to the sheet pressing means for retreating the sheet pressing means from the second sheet placing surface every time the sheet is ejected, and moving the sheet pressing means back to the second sheet placing surface, and sheet detecting means located at the upstream side of the ejecting means for detecting the sheet and actuating the driving means.

2. A sheet receiving apparatus as claimed in claim 1, wherein a sheet end regulating member for regulating a movement of an end rim of the sheet is provided at an end section of the second sheet placing surface.

3. A sheet receiving apparatus as claimed in claim 2, wherein the driving means moves the sheet pressing means from a sheet end regulating member side toward the second sheet placing surface side to press the ejected sheet every time the sheet is ejected by the ejecting means.

4. A sheet receiving apparatus as claimed in claim 1, wherein the sheet detecting means is sheet rear end detecting means for detecting a rear end of the sheet.

5. A sheet receiving apparatus, comprising:

ejecting means for ejecting a sheet, a temporary placing tray located at an upstream side of a sheet ejecting direction relative to the ejecting means and temporarily placing the sheet, sheet transferring means for transferring the sheet onto the temporary placing tray, aligning means for aligning the sheet transferred onto the temporary placing tray by the transferring means, said aligning means pressing the sheet from a direction crossing a sheet transferring direction relative to an opposing wall, the sheet transferring means and the aligning means being disposed such that at least one part of the aligning means regulates a side rim of the sheet at a position where the sheet transferring means contacts the sheet, and sheet pressing means disposed between the aligning means and the opposing wall to hang on the temporary placing tray, said sheet pressing means being movable in a sheet thickness direction of the sheet disposed on the temporary placing tray.

6. A sheet receiving apparatus as claimed in claim 5, wherein the sheet transferring means is formed of a ring-shaped member flexibly deforming in a thickness direction of the sheets placed on the temporary placing tray and in a crossing direction, respectively.

7. A sheet receiving apparatus as claimed in claim 5, wherein the sheet transferring means is formed of a driving pulley, a driven pulley, and a ring-shaped member extending between the driving pulley and driven pulley, at least a driven pulley side for contacting the sheet on the temporary placing tray being freely movable in a thickness direction of the sheets placed on the temporary placing tray.

8. A sheet receiving apparatus as claimed in claim 5, wherein said sheet pressing means is a sheet presser rotatably disposed above the temporary placing tray to press the sheet whenever the sheet is placed on the temporary placing tray.

9. A sheet receiving apparatus comprising:

ejecting means for ejecting a sheet, a temporary placing tray located at an upper stream side of a sheet ejecting direction relative to the ejecting means and temporarily placing the sheet, sheet transferring means for transferring the sheet onto the temporary placing tray, sheet regulating means located at an end portion of the temporary placing tray and regulating a transfer of the sheet transferred onto the temporary placing tray by the transferring means, and sheet pressing means disposed above the temporary placing tray and increasing a pressing force against the placed sheet in accordance with an increase of the sheets placed on the temporary placing tray.

10. A sheet receiving apparatus as claimed in claim 9, wherein the sheet pressing means is formed of first and second sheet pressing means having respectively different distances between a sheet contacting portion of the sheet pressing means and an upper surface of the temporary placing tray under a condition that the sheet is not placed on the temporary placing tray.

11. A sheet receiving apparatus as claimed in claim 9, wherein the sheet pressing mean is formed of first sheet pressing means having a first distance between a sheet contact portion of the sheet pressing means and a surface on the temporary placing tray, and second sheet pressing means having a sheet contact portion located with a distance longer than the first distance under a condition that the sheet is not placed on the temporary placing tray, said second sheet pressing means and first sheet pressing means being arranged in order at the sheet regulating means side from the upstream side of the sheet transferring direction by the sheet transferring means.

12. A sheet receiving apparatus, comprising:

ejecting means for ejecting a sheet, a sheet placing surface inclined such that the sheet is placed toward an upstream side of an ejecting direction of the ejecting means, sheet pressing means for pressing the sheet toward the second sheet placing surface, driving means connected to the sheet pressing means for retreating the sheet pressing means from the sheet placing surface every time the sheet is ejected, and moving the sheet pressing means back to the sheet placing surface, and sheet detecting means located at the upstream side of the ejecting means for detecting the sheet and actuating the driving means.

13. A sheet receiving apparatus as claimed in claim 12, wherein the sheet detecting means is sheet rear end detecting means for detecting a rear end of the sheet.

* * * * *